US009902171B2

(12) United States Patent
Hoshino et al.

(10) Patent No.: US 9,902,171 B2
(45) Date of Patent: Feb. 27, 2018

(54) IMAGE FORMING APPARATUS AND DRYING DEVICE FOR IMAGE FORMING APPARATUS

(71) Applicants: Yoshiaki Hoshino, Kanagawa (JP); Kenji Sato, Kanagawa (JP); Hirokazu Ikenoue, Tokyo (JP); Satoshi Kitaoka, Kanagawa (JP); Hideaki Nishimura, Kanagawa (JP); Yoko Ishii, Kanagawa (JP)

(72) Inventors: Yoshiaki Hoshino, Kanagawa (JP); Kenji Sato, Kanagawa (JP); Hirokazu Ikenoue, Tokyo (JP); Satoshi Kitaoka, Kanagawa (JP); Hideaki Nishimura, Kanagawa (JP); Yoko Ishii, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/449,557

(22) Filed: Mar. 3, 2017

(65) Prior Publication Data

US 2017/0173974 A1 Jun. 22, 2017

Related U.S. Application Data

(63) Continuation of application No. 14/871,301, filed on Sep. 30, 2015, now Pat. No. 9,616,681.

(30) Foreign Application Priority Data

Oct. 10, 2014 (JP) ..... 2014-208523
Dec. 7, 2014 (JP) ..... 2014-247504
Dec. 19, 2014 (JP) ..... 2014-257956

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS 4,483,083 A * 11/1984 Chance ..... D21F 5/04 34/113
5,279,050 A * 1/1994 Tormanen ..... D21F 5/04 34/117

(Continued)

FOREIGN PATENT DOCUMENTS

EP 1201429 A2 5/2002
JP 58-188685 11/1983

(Continued)

OTHER PUBLICATIONS

Mar. 15, 2016 European Search Report in connection with European patent application No. 15187972.3.

(Continued)

*Primary Examiner* — Alessandro Amari
*Assistant Examiner* — Roger W Pisha, II
(74) *Attorney, Agent, or Firm* — Cooper & Dunham LLP

(57) ABSTRACT

An image forming apparatus includes an image forming unit to form an image on a recording medium by discharging liquid droplets onto the medium; and a media heater to heat the medium by contacting a rear surface of the medium opposite a surface of the medium on which the image is formed, in which the media heater includes a contact member with a contact surface having a predetermined curvature that the medium contacts, the contact member is a roller member, and the medium closely contacts the contact sur- (Continued)

face of the contact member across an entire width of the medium in a direction perpendicular to the media conveyance direction.

12 Claims, 20 Drawing Sheets

(56) References Cited

U.S. PATENT DOCUMENTS

| | | | | |
|---|---|---|---|---|
| 5,787,809 | A | 8/1998 | Bosse | |
| 9,616,681 | B2 * | 4/2017 | Hoshino | B41J 11/0015 |
| 2009/0297245 | A1 | 12/2009 | Godden et al. | |
| 2010/0194815 | A1 | 8/2010 | Furukawa | |
| 2011/0109683 | A1 | 5/2011 | Williams et al. | |
| 2011/0267393 | A1 | 11/2011 | Okamoto | |
| 2013/0293617 | A1 | 11/2013 | Suzuki et al. | |
| 2014/0092183 | A1 | 4/2014 | Bradley | |
| 2014/0132658 | A1 | 5/2014 | Suzuki et al. | |
| 2014/0232797 | A1 | 8/2014 | Onodera et al. | |

FOREIGN PATENT DOCUMENTS

| | | |
|---|---|---|
| JP | 60-30345 | 2/1985 |
| JP | 63-159053 | 7/1988 |
| JP | 5-096722 | 4/1993 |
| JP | 5-104800 | 4/1993 |
| JP | 5-155007 | 6/1993 |
| JP | 2002-347226 | 12/2002 |
| JP | 2005-313458 | 11/2005 |
| JP | 2010-167592 | 8/2010 |
| JP | 2010-208099 | 9/2010 |
| JP | 2010-208107 | 9/2010 |
| JP | 2011-173383 | 9/2011 |
| JP | 2013-28022 | 2/2013 |
| JP | 2013-248881 | 12/2013 |

OTHER PUBLICATIONS

European official action dated Feb. 10, 2017 in connection with corresponding European patent application No. 15187972.3.

* cited by examiner

| HEAT ROLLER RADIUS | | | | |
|---|---|---|---|---|
| BASIS WEIGHT | 50mm | 75mm | 100mm | 125mm |
| 90gsm | CLOSELY CONTACT | CLOSELY CONTACT | NOT CLOSELY CONTACT | NOT CLOSELY CONTACT |
| 130gsm | CLOSELY CONTACT | CLOSELY CONTACT | CLOSELY CONTACT | CLOSELY CONTACT |

| MEDIA CONVEYANCE SPEED (m/min) | DRYING HEATER TEMPERATURE |
|---|---|
| 10 | 60°C |
| 20 | 80°C |
| 30 | 100°C |

| BASIS WEIGHT | DRYING HEATER TEMPERATURE |
|---|---|
| <60 gsm | 60°C |
| ≥60 gsm AND <100 gsm | 80°C |
| ≥100 gsm | 100°C |

| MAXIMUM INK ADHESION AMOUNT ($\mu$l/INCH$^2$) | DRYING HEATER TEMPERATURE |
|---|---|
| < 2.0 | 60°C |
| ≥ 2.0 AND < 3.0 | 80°C |
| ≥ 3.0 | 100°C |

| MEDIA CONVEYANCE SPEED (m/min) | NUMBER OF HEATERS USED |
|---|---|
| 30 | 6 |
| 20 | 4 |
| 30 | 2 |

| BASIS WEIGHT | NUMBER OF HEATERS USED |
|---|---|
| ≥100 gsm | 6 |
| ≥60 gsm AND <100 gsm | 4 |
| <60 gsm | 2 |

| MAXIMUM INK ADHESION AMOUNT ($\mu$l/INCH$^2$) | NUMBER OF HEATERS USED |
|---|---|
| ≥ 3.0 | 6 |
| ≥ 2.0 AND < 3.0 | 4 |
| < 2.0 | 2 |

IMAGE FORMING APPARATUS AND DRYING DEVICE FOR IMAGE FORMING APPARATUS

CROSS-REFERENCE TO RELATED APPLICATIONS

The present application is a Rule 1.53(b) continuation of application Ser. No. 14/871,301 filed Sep. 30, 2015 which claims priority pursuant to 35 U.S.C. § 119(a) from Japanese patent application numbers 2014-208523, 2014-257956, and 2014-247504, filed on Oct. 10, 2014, Dec. 19, 2014, and Dec. 7, 2014, respectively, the entire disclosure of each of which is incorporated by reference herein.

BACKGROUND

Technical Field

The present invention relates to a drying device for an image forming apparatus and an image forming apparatus including the drying device.

Background Art

In image forming apparatuses employing a liquid discharging recording method in which a liquid discharge head to discharge liquid droplets is used as a recording head, a drying device is provided to accelerate drying of the liquid droplets impacted on, for example, a recording medium such as a sheet of paper, etc.

For example, a heat roller having a polygonal shape is contacted against a rear surface of the medium (on which no image is formed), such that ridge-like portions of the heat roller press against the medium locally. As a result, wrinkles in the medium on the ridge-like portion are stretched for more effective drying.

SUMMARY

In one embodiment of the disclosure, provided is an image forming apparatus including an image forming unit to form an image on a recording medium by discharging liquid droplets onto the medium; and a media heater to heat the medium by contacting a rear surface of the medium opposite a surface of the medium on which the image is formed, in which the media heater includes a contact member with a contact surface having a predetermined curvature that the medium contacts, the contact member is a roller member, and the medium closely contacts the contact surface of the contact member across an entire width of the medium in a direction perpendicular to the media conveyance direction.

In another embodiment of the disclosure, there is provided a drying device for the above-described image forming apparatus.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described referring to accompanying drawings.

Figures 1, 2:
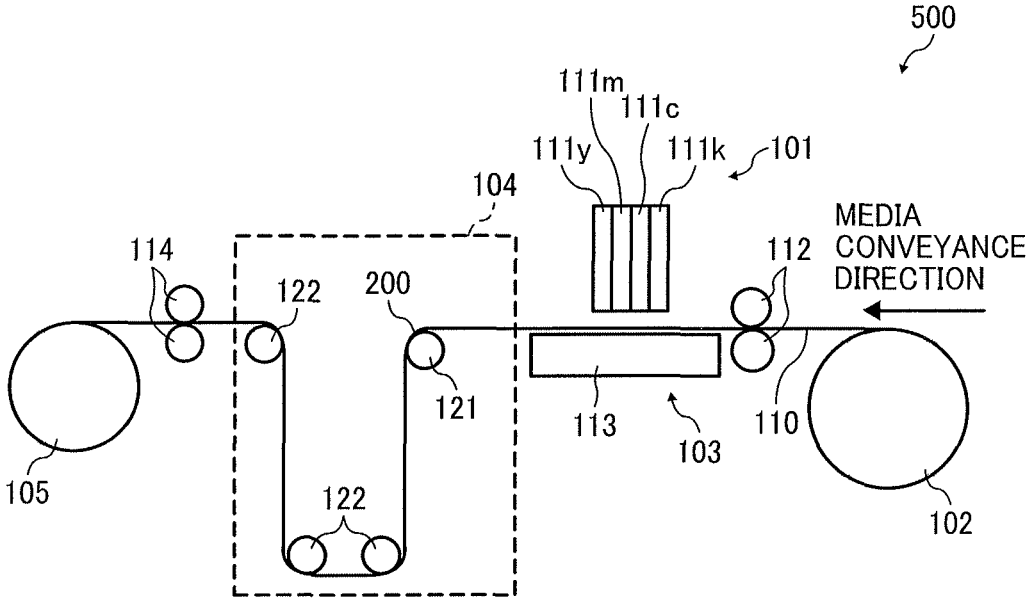
FIG. 1 illustrates principal parts of an exemplary image forming apparatus according to an embodiment of the present invention.
FIG. 2 is a table showing evaluation results of adherence of a medium to a heat roller when a basis weight of the medium and a radius of the heat roller are changed.

FIG. 1 illustrates principal parts of an exemplary image forming apparatus 500. The image forming apparatus is a full-line type inkjet recording apparatus, including an image forming section 101 formed of liquid discharge heads to discharge liquid droplets of a predetermined color to a recording medium or, simply, a medium 110 being a continuous sheet.

The image feinting section 101 includes four full-line type recording heads 111K, 111C, 111M, and 111Y, disposed from upstream in the media conveyance direction to downstream. Suffixes of K, C, M, and Y mean a color of black, cyan, magenta, and yellow, respectively. Each of the recording heads 111K, 111C, 111M, and 111Y discharges droplets of black (K), cyan (C), magenta (M), or yellow (Y), respectively, to the medium 110 that has been conveyed thereto. Colors of ink and the number of the colors are not limited to the above.

The medium 110 fed out from an original roll 102, is conveyed by a feed roller pair 112 of a conveyance part 103 onto a feed guide unit 113 disposed opposite the image forming section 101, and is further guided and conveyed by the feed guide unit 113.

The medium 110 on which an image is formed by the image forming section 101 passes through a drying device 104 according to the present embodiment, is conveyed by a discharge roller pair 114, and is wound up by a wind-up roll 105.

The drying device 104 includes a heat roller 121 and a plurality of guide rollers 122. Each of the heat rollers 121 serves as a heating member and a contact member.

The heat roller 121 is disposed to contact a rear side of the medium 110, opposite a surface on which an image is formed.

The heat roller 121 includes a circumferential surface including a contact surface 200 having a predetermined curvature that the medium 110 contacts, and the medium 110 closely contacts the contact surface 200 at a contacting area in the media conveyance direction across an entire width of the medium in a direction of the heat roller 121 perpendicular to the media conveyance direction.

Specifically, the curvature of the circumferential surface of the contact surface 200 of the heat roller 121 is the curvature in which the medium 110 closely contacts the contact surface 200 across an entire width of the medium in a direction perpendicular to the media conveyance direction.

More specifically, the heat roller 121 is configured to have a radius R that is equal to 75 mm (ϕ150 mm) or less, when the apparatus employs the medium 110 having a basis weight of less than 100 gsm (gram per square meter or g/m$^2$). In addition, the heat roller 121 is configured to have a radius R that is equal to 125 mm ((ϕ250 mm) or less, when the apparatus employs the medium 110 having a basis weight of 100 gsm or greater.

In this case, the lowest limit of the radius of the heat roller 121 is preferably 30 mm or greater, because a heat source is disposed inside, a certain strength is required for the heat roller 121, and a width that the heat roller 121 presses and heats the medium 110 is preferably longer so as to easily transmit heat to the medium 110.

FIG. 2 is a table showing evaluation results of adherence of the medium 110 to the heat roller 121 when a basis weight of the medium 110 and a radius R of the heat roller 121 are changed.

Conditions used for evaluation are as follows:

Medium: coated paper with 90 gsm and 130 gsm;

Media conveyance speed: 50 m/min;

Ink: water based ink;

Resolution: 1,200×1,200 dpi;

Ink adhesion amount: 4.0 μl/inch$^2$ (solid coat);

Roller radius: 50 mm, 75 mm, 100 mm, and 125 mm; and

Heating temperature: 100° C.

Adherence was evaluated under the above conditions. When the medium is cockled, if the medium is separated from the heat roller 121 more than 0.1 mm, the heat transfer efficiency drastically decreases. Accordingly, as to the adherence property, a laser measuring equipment is used to measure the distance between the medium and the heat roller. If the distance from which a thickness of the medium is subtracted, is 0.05 mm or less, it is evaluated that the medium closely contacts the heat roller.

As understood from the result, the medium that weighs 90 gsm, closely contacts the heat roller having a radium R=50 mm or 75 mm. By contrast, the medium does not closely contact, due to floating of the medium, the heat roller having a radius R that equals 100 mm or 125 mm.

The medium that weighs 130 gsm closely contacts the heat roller having a radius R=50 mm, 75 mm, 100 mm, or 125 mm.

Figure 4:
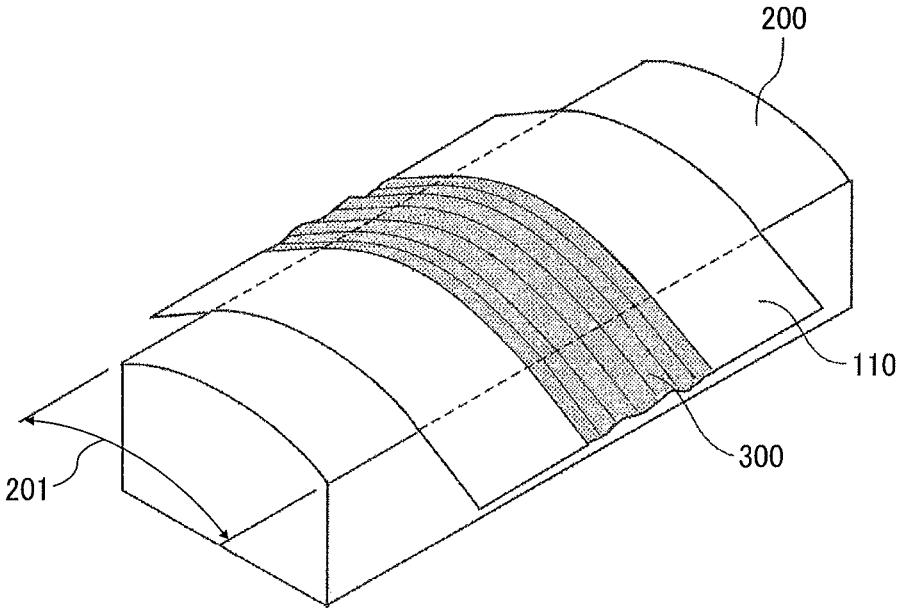
FIG. 4 is a perspective view illustrating adherence of a medium to a contact surface according to a comparative example of the present invention.

Specifically, when the curvature of the contact surface 200 is small or the radius is large as in a comparative example of FIG. 4, the medium 110 does not closely contact the contact surface 200 at several points in the width direction of the medium 110 that is a perpendicular direction relative to the media conveyance direction in a contact range 201 with the contact surface 200, due to cockling of the medium 110 occurring due to adhesion of the liquid in the image formation.

As a result, because heat from the contact surface 200 is not transferred or radiation heat alone is transferred in a portion where the medium 110 floats from and does not closely contact the contact surface 200, uneven drying occurs in the width direction of the heat roller perpendicular to the media conveyance direction and drying is not done effectively.

Figure 3:
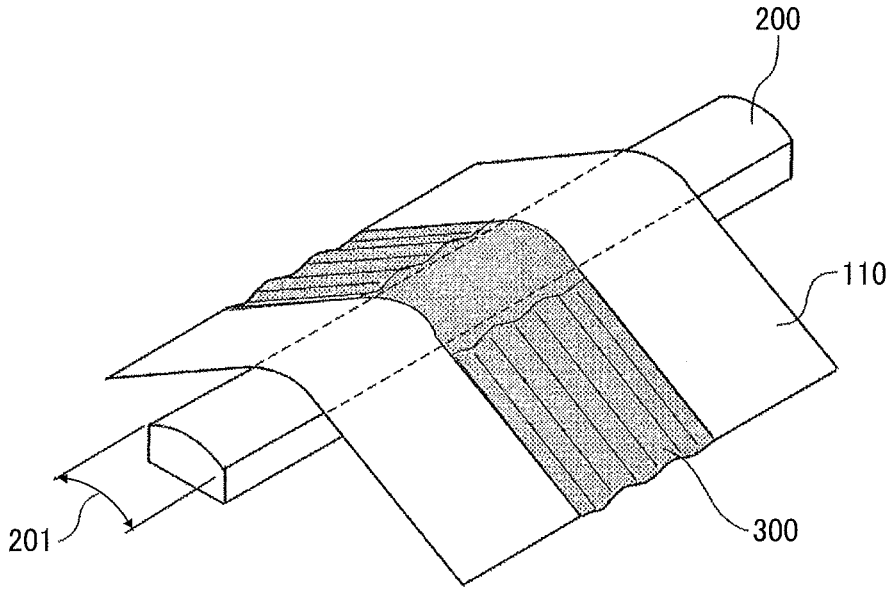
FIG. 3 is a perspective view illustrating adherence of a medium to a contact surface according to an embodiment of the present invention.

By contrast, when the curvature of the contact surface 200 is large or the radius is small as illustrated in FIG. 3 according to the present embodiment, the medium 110 closely contacts the contact surface 200 because the cockling of the medium 110 occurring due to adhesion of the liquid in the image formation is corrected. That is, because the cockling is corrected, the medium 110 evenly contacts the contact surface 200 and does not float therefrom.

With this structure, the medium 110 closely contacts the contact surface 200 across an entire width of the medium in a direction perpendicular to the media conveyance direction, the heat from the contact surface 200 is directly transferred to the medium 110, and the medium 110 can be effectively dried.

Thus, the medium closely contacts the contact surface across an entire width of the medium in a direction perpendicular to the media conveyance direction in the contact area in the media conveyance direction, heating by the drying device can be performed effectively and liquid droplets adhered to the medium can be swiftly dried.

Next, a second embodiment according to the present invention will be described with reference to FIG. 5.

Figure 5:
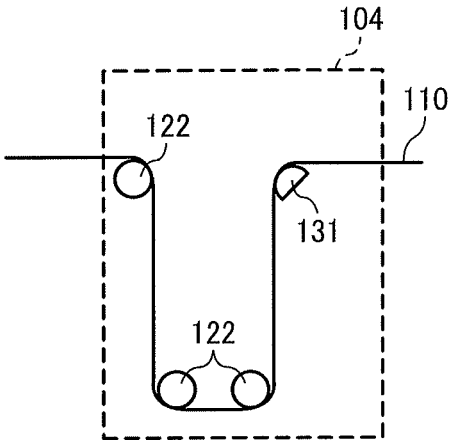
FIG. 5 illustrates a drying device according to a second embodiment of the present invention.

FIG. 5 illustrates a drying device according to the second embodiment. In the present embodiment, instead of the heat roller 121 in the first embodiment, a curved surface heater 131 having a convex curved contact surface is disposed.

With such a configuration, the cockling of the medium 110 due to adhesion of the liquid in the image formation is corrected and the medium 110 closely contacts the curved contact surface of the convex curved surface heater 131, so that the heating is performed as effectively as the first embodiment of the present invention.

It is noted that the curvature of the curved surface heater 131 does not need to be constant, and can be within a range such that the medium 110 closely contacts the contact surface 200 across an entire range of the width direction perpendicular to the media conveyance direction in the contact area in the media conveyance direction of the medium 110.

Figure 6:
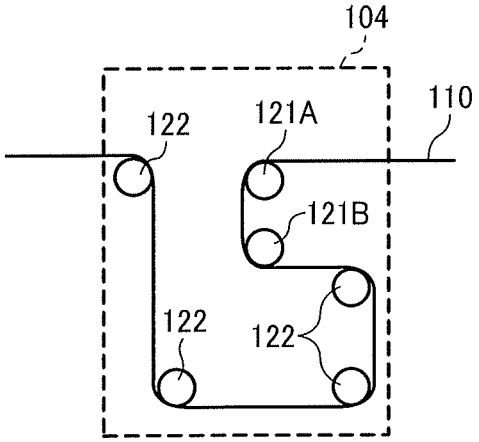
FIG. 6 illustrates a drying device according to a third embodiment of the present invention.

Next, a third embodiment according to the present invention will be described with reference to FIG. 6, which illustrates a drying device according to the third embodiment.

In the third embodiment, two heat rollers 121A, 121B are disposed along the media conveyance direction. The number of heaters is not limited to two and can be three or more.

The configuration as described above may dry the medium 110 more efficiently in a short time of period.

Herein, the contact area of the medium 110 relative to one heat roller ranges 90 degrees or less in the circumferential direction of the heat roller and within one fourth or below of the full length of the circumference. Namely, an angle formed by a tangent line passing a contact start point where the medium 110 starts to contact a circumferential surface of the heat roller and a tangent line passing a contact end point where the medium 110 separates from the circumferential surface of the heat roller may only be 90 degrees or less.

The two or more heat rollers are disposed, so that a direction changes more than 180 degrees.

The temperature of the heat roller or the curved surface heater in each of the embodiments is detected by a temperature sensor and controlled to a predetermined set temperature by a feedback controller.

Figure 7:
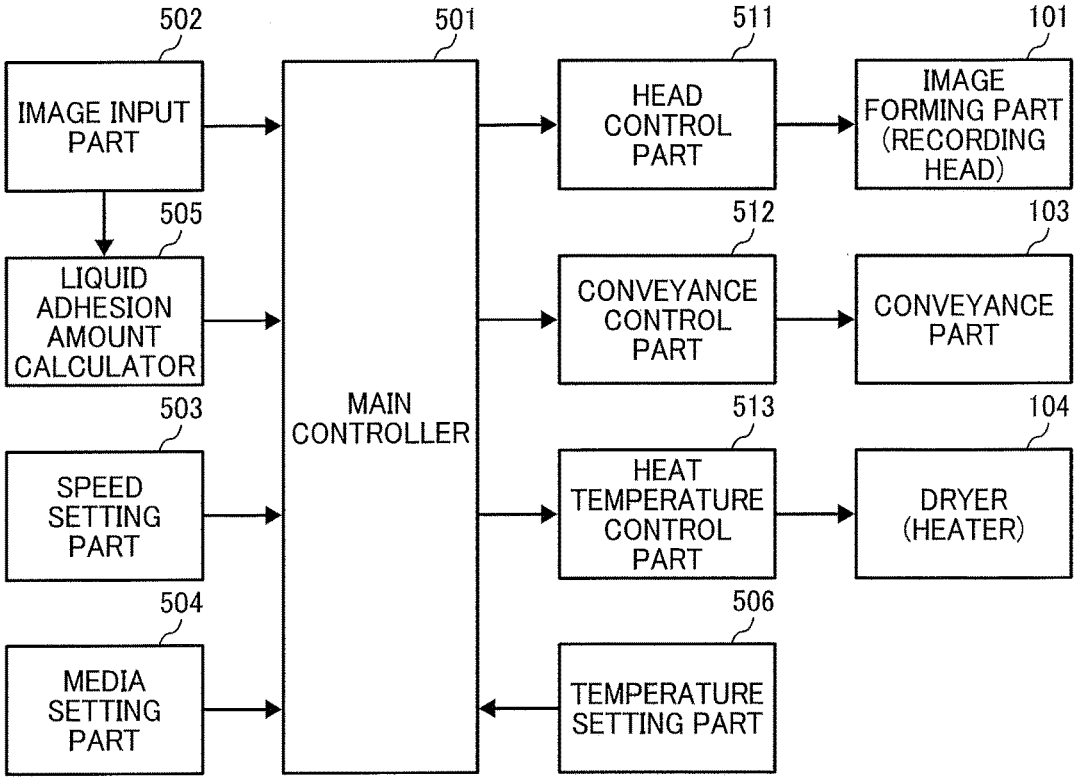
FIG. 7 is a block diagram of a controller of the image forming apparatus.

Next, an outline of a controller section in the image forming apparatus 500 will be described with reference to FIG. 7. FIG. 7 is a block diagram of the controller section of the image forming apparatus 500.

The controller section includes a main controller 501 including a CPU, a ROM, a RAM, an I/O, and the like.

The main controller 501 is sent image data from an image input part 502 to input information related to a print image from an external source, setting data of media conveyance speed from a speed setting part 503, and information related to the basis weight ($g/m^2$) of the medium from a media setting part 504.

In addition, the image data from the image input part 502 is sent to a liquid adhesion amount calculator 505, which calculates a liquid adhesion amount as a result of printing the image, and the data is sent to the main controller 501.

The main controller 501 causes a conveyance control part 512 to drive rotatably the feed roller pair 112 and the discharge roller pair 114 of the conveyance part 103, to thereby convey the medium 110 opposing to the image forming section 101. Then, based on the image data of the image input part 502, the main controller 501 causes a head control part 511 that drives the recording head 111 of the image forming section 101 to discharge liquid droplets and form an image on the medium 110.

In addition, the main controller 501 reads out data of heating temperature from a temperature sensor 506 that detects a temperature by the heating member of the drying device 104, and controls a heating temperature control part 513 so as to control the heating temperature by the heat roller 121 or the curved surface heater 131 of the drying device 104 at a predetermined temperature, thereby drying the medium 110 on which the image has been formed.

Figure 8:
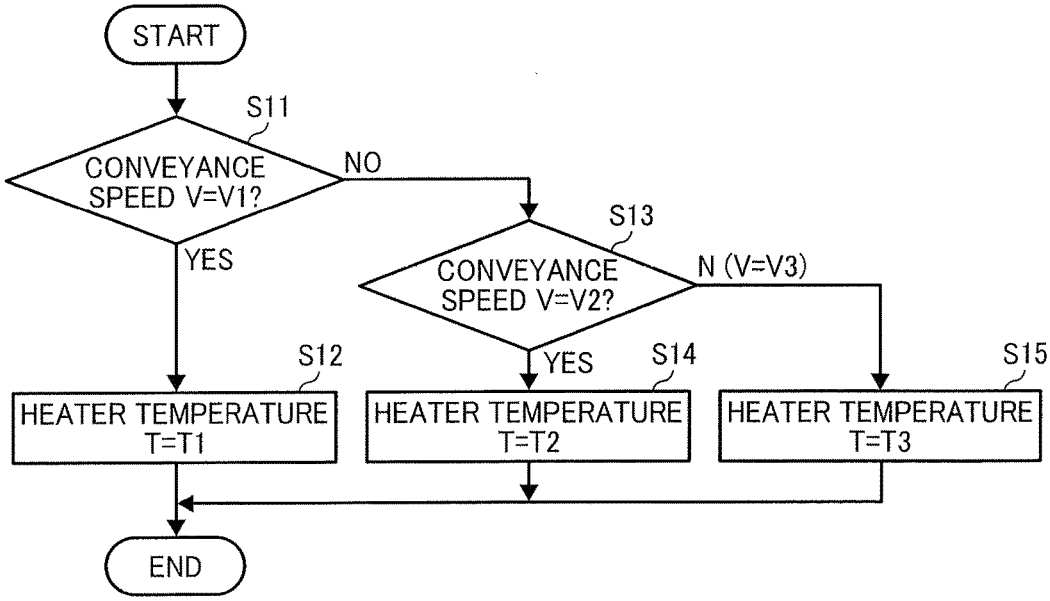
FIG. 8 is a flowchart showing steps in a process of controlling a heating temperature according to a fourth embodiment of the present invention.

Next, referring to FIG. 8, a fourth embodiment of the present invention will be described.

The main controller 501 determines whether or not a media conveyance speed V set by the speed setting part 503 is a predetermined speed V1 (in step S11).

When the media conveyance speed V is equal to the predetermined speed V1 (S12), the heating temperature is set to a temperature T1.

By contrast, when the media conveyance speed V is not equal to the predetermined speed V1, the main controller 501 determines whether or not the media conveyance speed V is equal to another predetermined speed V2 (V1<V2) (S13).

Here, when the media conveyance speed V is equal to another predetermined speed V2, the heating temperature of the heat roller 121 is set at a temperature T2 which is higher than T1 (T1<T2) (S14), and the heat roller 121 is controlled.

By contrast, when the media conveyance speed V is not equal to the predetermined speed V2, that is, when the media conveyance speed V is equal to further another predetermined speed V3 (V2<V3), the heating temperature of the heat roller 121 is set at a temperature T3 which is higher than T2 (T2<T3) (S15).

Figures 9, 10, 11:
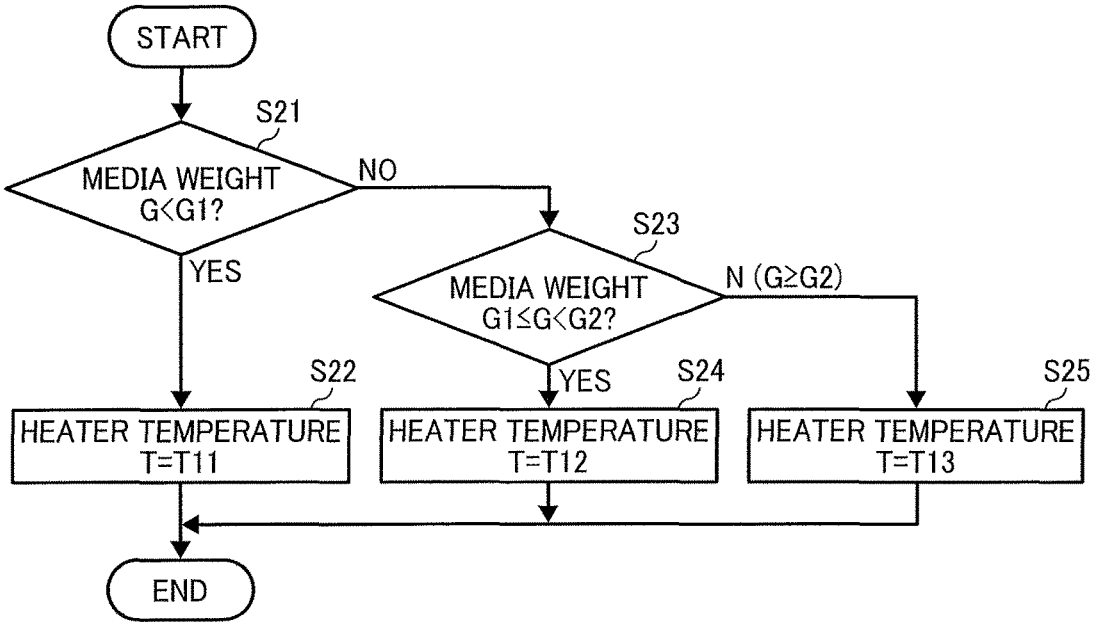
FIG. 9 is a table showing actual exemplary drying heater temperatures by media conveyance speed.
FIG. 10 is a flowchart showing steps in a process of controlling a heating temperature according to a fifth embodiment of the present invention.
FIG. 11 is a table showing actual exemplary drying heater temperature by basis weight of the medium.

As illustrated in FIG. 9, when the media conveyance speed (printing speed) V is equal to 10 m/min, the heating temperature (that is, the temperature of the dryer heater) is set to 60° C. Similarly, when the media conveyance speed V is equal to 20 m/min, the heating temperature is set to 80° C. Further similarly, when the media conveyance speed V is equal to 30 m/min, the heating temperature is set to 100° C.

Specifically, as the conveyance speed of the medium 110 increases, the time to contact the heat roller 121 shortens, and the time to dry the medium 110 also shortens. Thus, to reliably dry the liquid droplets impacted on the medium 110, the heating temperature of the heat roller 121 is raised.

When the media conveyance speed is equal to the predetermined speed or greater, the heating temperature of the media heating member is raised more than the case in which the media conveyance speed is less than the predetermined speed, so that the drying can be performed reliably.

Next, referring to FIG. 10, a fifth embodiment of the present invention will be described.

The main controller 501 determines whether or not a basis weight G of the medium set by the media setting part 504 is less than a predetermined amount G1 (G<G1) (in step S21).

Herein, when the basis weight G of the medium is less than the predetermined amount G1, the heating temperature of the heat roller 121 is set to a temperature T11 (S22).

By contrast, when the basis weight G of the medium is not less than the predetermined amount G1, the main controller 501 determines whether or not the basis weight G of the medium is the predetermined amount G1 or more and less than a predetermined amount G2 (G1≤G<G2) (S23).

Herein, when the basis weight G of the medium is the predetermined amount G1 or more and less than the predetermined amount G2 (G1≤G<G2), the heating temperature of the heat roller 121 is set to a temperature T12 (T11<T12) (S24).

By contrast, when the basis weight G of the medium is not the predetermined amount G1 or more and less than the predetermined amount G2 (G1≤G<G2), that is, when the basis weight G of the medium is the predetermined amount G2 or more, the heating temperature of the heat roller 121 is set to a temperature T13 (T12<T13) (S25).

For example, as illustrated in FIG. 11, when the basis weight G of the medium is less than 60 gsm, the heating temperature (that is, the temperature of the dryer heater) is set to 60° C. Similarly, when 60 gsm or more, and less than 100 gsm, the heating temperature is set to 80° C. Further similarly, when 100 gsm or more, the heating temperature is set to 100° C.

In short, when the basis weight of the medium 110, or the thickness thereof, increases, more energy is required to heat by the heat roller 121. Thus, to reliably dry the liquid droplets impacted on the medium 110, the heating temperature of the heat roller 121 is raised.

When the basis weight per square meters (g/m$^2$) of the medium is equal to the predetermined amount or greater, the heating temperature of the media heating member is raised more than the case in which the basis weight is less than the predetermined amount, so that the drying can be performed reliably even though the medium has a greater thickness.

Next, referring to a flowchart of FIG. 12, a sixth embodiment of the present invention will be described.

The main controller 501 determines whether or not a liquid adhesion amount D calculated by a liquid adhesion amount calculator 505 is less than a predetermined amount D1 (D<D1) (S31).

Herein, when the liquid adhesion amount D is less than the predetermined amount D1, the heating temperature of the heat roller 121 is set to a temperature T21 (S32) and is controlled.

By contrast, when the liquid adhesion amount D is not less than the predetermined amount D1, the main controller 501 determines whether or not the liquid adhesion amount D is equal to or greater than the predetermined amount D1 and less than a predetermined amount D2 (D1≤D<D2) (S33).

Herein, when the liquid adhesion amount D is equal to or greater than the predetermined amount D1 and less than the predetermined amount D2 (D1≤D<D2), the heating temperature of the heat roller 121 is set to a temperature T22 (T21<T22) (S34) and is controlled.

By contrast, when the liquid adhesion amount D is not equal to or greater than the predetermined amount D1 and less than the predetermined amount D2 (D1≤D<D2), that is, when the liquid adhesion amount D equals the predetermined amount D or greater, the heating temperature of the heat roller 121 is set to a temperature T23 (T22<T23) (S35) and is controlled.

Figures 12, 13:
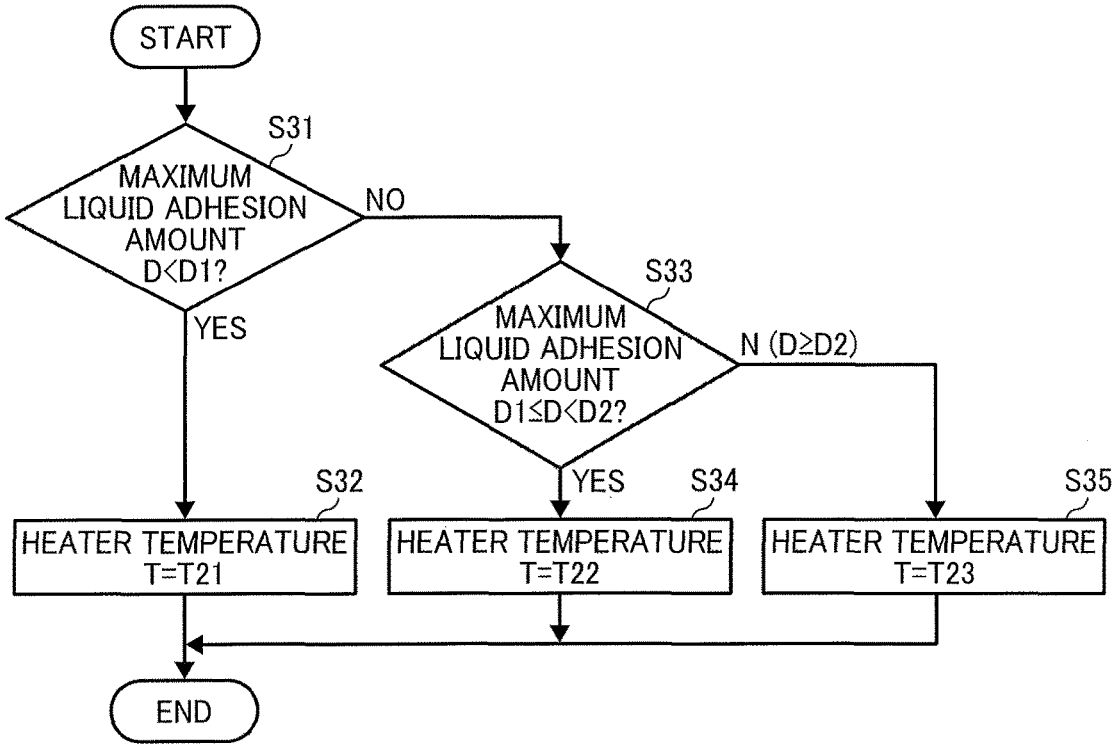
FIG. 12 is a flowchart showing steps in a process of controlling a heating temperature according to a sixth embodiment of the present invention.
FIG. 13 is a table showing actual exemplary drying heater temperature by maximum ink adhesion amount.

For example, as illustrated in FIG. 13, when a maximum ink adhesion amount D (μl/inch$^2$) is less than 2.0, the heating temperature of the heat roller 121 is set to 60° C. Similarly, when the maximum ink adhesion amount D is equal to 2.0 or greater and less than 3.0, the heating temperature is set to 80° C. Further similarly, when 3.0 or greater, the heating temperature is set to 100° C.

In short, when the liquid adhesion amount relative to the medium 110 increases, drying the medium 110 by the heat roller 121 requires more energy. Thus, to reliably dry the liquid droplets impacted on the medium 110, the heating temperature of the heat roller 121 is raised.

When the liquid adhesion amount relative to the medium is equal to the predetermined amount or greater, the heating temperature of the media heating member is raised more than the case in which the liquid adhesion amount is less than the predetermined amount, so that the drying can be performed reliably even though the liquid adhesion amount increases.

The description above is based on rules that T1=T11=T21, T2=T12=T22, and T3=T13=T23; however, these temperatures may be varied. Further, without limiting to the three-step control, the temperature may be controlled in two or in four or more steps.

Figure 14:
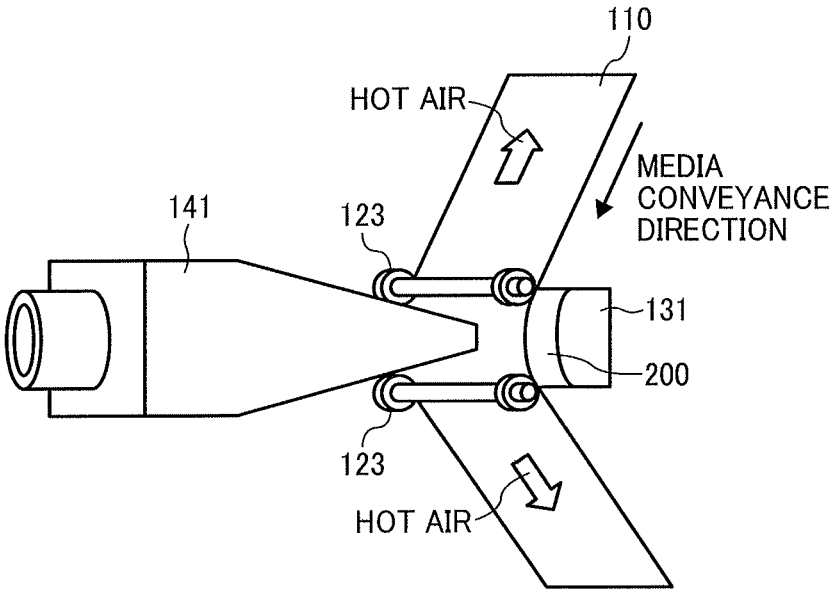
FIG. 14 is a perspective view of a hot air blower according to a seventh embodiment of the present invention.

Next, referring to FIG. 14, a seventh embodiment of the present invention will be described. FIG. 14 is a perspective view of the heating member illustrating the seventh embodiment of the present invention.

In the present embodiment, in addition to the curved surface heater 131 being a contact portion of the media heating member, pressing rollers 123 to press the medium 110 against the contact surface 200 of the curved surface heater 131 are disposed.

Then, a hot air blower 141 is disposed to blow the hot air to an area of the medium 110 heated by the contact surface 200 of the curved surface heater 131.

With such a configuration, the medium 110 is heated by the curved surface heater 131 and heated by the hot air blown from the hot air blower 141. At the same time, the temperature boundary layer that evaporated liquid solvent forms at a surface of the medium 110 thins out and heat transfer is accelerated.

With this structure, the medium 110 can be dried more effectively.

It is preferred that the hot air blown off from the hot air blower 141 might blow at a relative speed of 20 m/s or more to the surface of the medium 110. At the same time, the temperature boundary layer that evaporated liquid solvent forms on the surface of the medium 110 can be removed securely and the heat transfer is accelerated.

Figure 15:
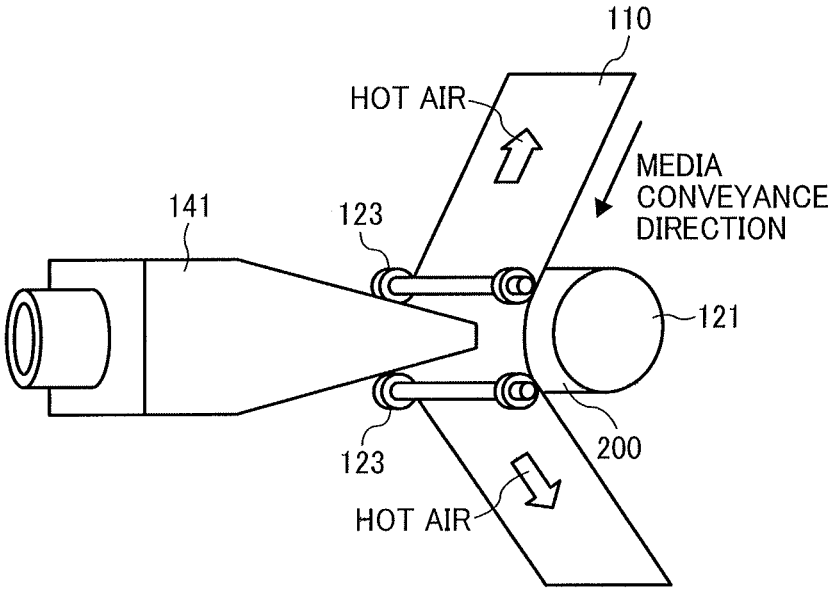
FIG. 15 is a perspective view of the hot air blower according to an eighth embodiment of the present invention.

Next, an eighth embodiment according to the present invention will be described with reference to FIG. 15. FIG. 15 is a perspective view of the heating member illustrating the eighth embodiment of the present invention.

In the present embodiment, a heat roller 121 is disposed as a contact member of the media heating member.

The other structure of the eighth embodiment is identical to that in the seventh embodiment.

Figure 16:
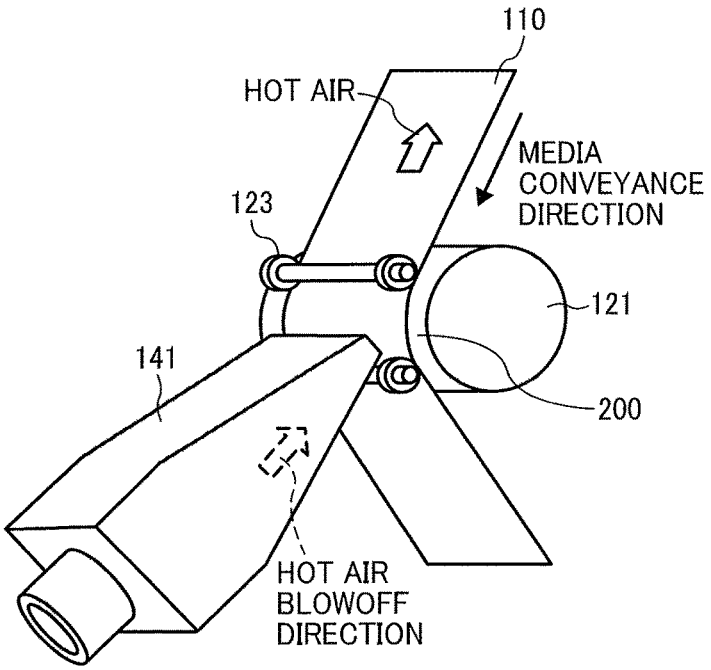
FIG. 16 is a perspective view of the hot air blower according to a ninth embodiment of the present invention.

Next, referring to FIG. 16, a ninth embodiment of the present invention will be described. FIG. 16 is a perspective view of the heating member illustrating the ninth embodiment of the present invention.

In the present embodiment, the hot air blower 141 is disposed to blow off hot air toward upstream in the media conveyance direction. Namely, the hot air blows in the counter direction relative to the media conveyance direction.

Figure 17:
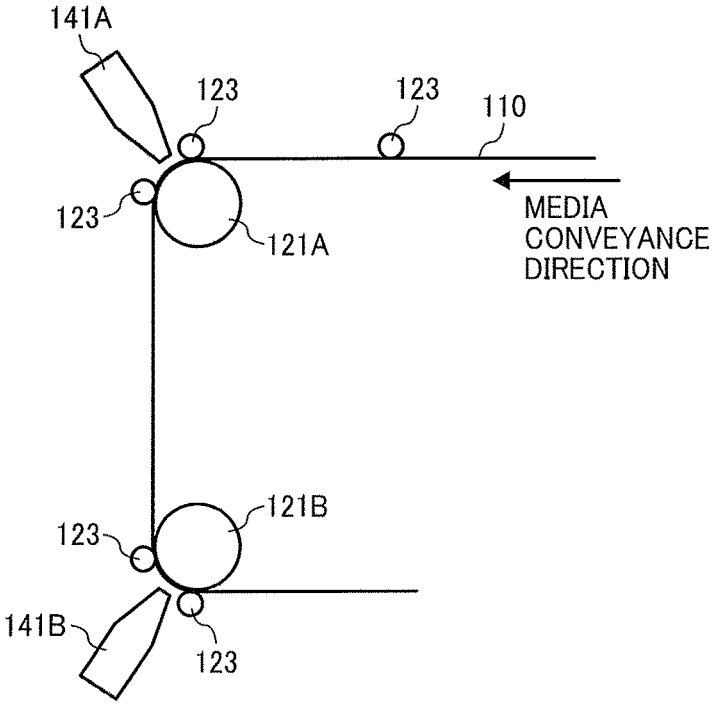
FIG. 17 is a perspective view of the hot air blower according to a tenth embodiment of the present invention.

Next, a tenth embodiment of the present invention will be described with reference to FIG. 17. FIG. 17 is a perspective view of the heating member illustrating the tenth embodiment of the present invention.

In the present embodiment, a plurality of heat rollers 121A, 121B and a plurality of hot air blowers 141A, 141B are disposed along the media conveyance direction.

Drying of the medium can be accelerated by heating and hot-air blowing at multiple positions.

It is preferred that a radius Ra of an upstream side heat roller 121A and a radius Rb of a downstream heat roller 121B have a relation of Ra<Rb from the viewpoint of reliably correcting the cockling of the medium and increasing heat amount (or the contact area and time period) by the small-radius heat roller from a rear side of the medium. This relation is preferably retained between three or more heating members.

Figure 18:
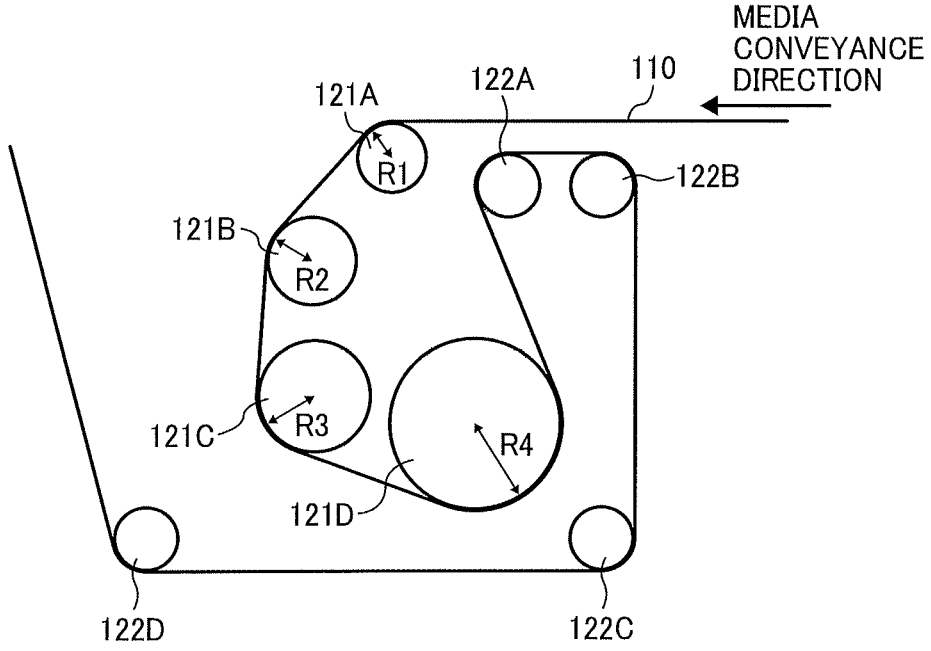
FIG. 18 is an enlarged perspective view of the drying device including a plurality of heat rollers according to an eleventh embodiment of the present invention.

FIG. 18 is an enlarged perspective view of the drying device 104 including a plurality of heat rollers 121A to 121D according to an eleventh embodiment of the present invention.

It is noted that the heat rollers 121A to 121D can be generally and collectively referred to as the heat roller 121 when used indiscriminately. The drying device 104 further includes a plurality of guide rollers 122A to 122D.

In the present embodiment, a radius R of each of the heat rollers 121A, 121B, 121C, and 121D is defined as R1, R2, R3, and R4 (R1<R2<R3<R4), respectively, and the radius R of the heat roller increases toward downstream in the conveyance direction.

Accordingly, in the media conveyance direction, the heat rollers 121A, 121B, 121C, and 121D sequentially disposed from upstream each include a sequentially decreasing curvature.

With this configuration, the medium 110 sent into the drying device 104 contacts a circumferential surface of the heat roller 121A with a greatest curvature, the cockling thereof is corrected along the circumferential shape of the heat roller 121A, and the medium 110, a rear side of which the heat roller 121A closely contacts, is heated and dried.

In this state, because the liquid on the medium 110 is dried to a certain degree, the cockling recovered after passing through the heat roller 121A becomes smaller than in an initial time.

Thereafter, the medium 110 contacts a circumferential surface of the heat roller 121B with a second greatest curvature, the cockling thereof is corrected along the circumferential shape of the heat roller 121B, and the medium 110, a rear side of which the heat roller 121B closely contacts, is heated and dried. In this case, because the curvature of the heat roller 121B is smaller than that of the heat roller 121A, the contact time period with the medium 110 is longer, thereby accelerating heat transfer and drying. In this step, because the liquid of the medium 110 is further dried, the cockling recovered after passing through the heat roller 121B becomes smaller than in the previous step (after passing through the heat roller 121A).

Thereafter, the medium 110 contacts a circumferential surface of the heat roller 121C with a third greatest curvature, the cockling thereof is corrected along the circumferential shape of the heat roller 121C, and the medium 110, a rear side of which the heat roller 121C closely contacts, is heated and dried. In this case, because the curvature of the heat roller 121C is smaller than that of the heat roller 121B, the contact time period with the medium 110 is longer, thereby accelerating heat transfer and drying. In this step, because the liquid of the medium 110 is further dried, the cockling recovered after passing through the heat roller 121C becomes smaller than in the previous step (after passing through the heat roller 121B).

Thereafter, the medium 110 contacts a circumferential surface of the heat roller 121D with a greatest curvature, the cockling thereof is corrected along the circumferential shape of the heat roller 121D, and the medium 110, a rear side of which the heat roller 121D closely contacts, is heated and dried. In this case, because the curvature of the heat roller 121D is smaller than that of the heat roller 121C, the contact time period with the medium 110 is longer, thereby accelerating heat transfer and drying. The cockling is eliminated in this step after passing through the heat roller 141D.

Thus, by providing a plurality of contact members with a curvature sequentially reducing toward downstream in the media conveyance direction, cockling is reliably reduced and drying is performed effectively.

In the present embodiment, a case in which all of the plurality of contact members have different curvatures is explained; however, among two contact members that the medium contacts sequentially in the conveyance direction, the curvature of the downstream contact member may only be smaller than that of the upstream contact member.

For example, in the present embodiment, the heat rollers 121A and 121B, the heat rollers 121B and 121C, or alternatively, the heat rollers 121C and 121D may have the same curvature.

In addition, when the medium 110 used in the present embodiment is a continuous sheet, because an entire width of the rear surface of the medium 110 contacts the heat rollers 121, extension and contraction in the media width direction (that is, the direction perpendicular to the conveyance direction) due to heating can be suppressed by the friction, so that difference in the extension and contraction between a printing portion (liquid adhering part) and a non-printing portion (no liquid adhering part) serves as an internal stress.

However, because restriction in the media width direction is once released between the heat roller 121 and the next heat roller 121, the internal stress due to difference in the extension and contraction is moderated and is uniformed when contacting the next heat roller 121, thereby accelerating correction effect of the cockling.

Figure 19:
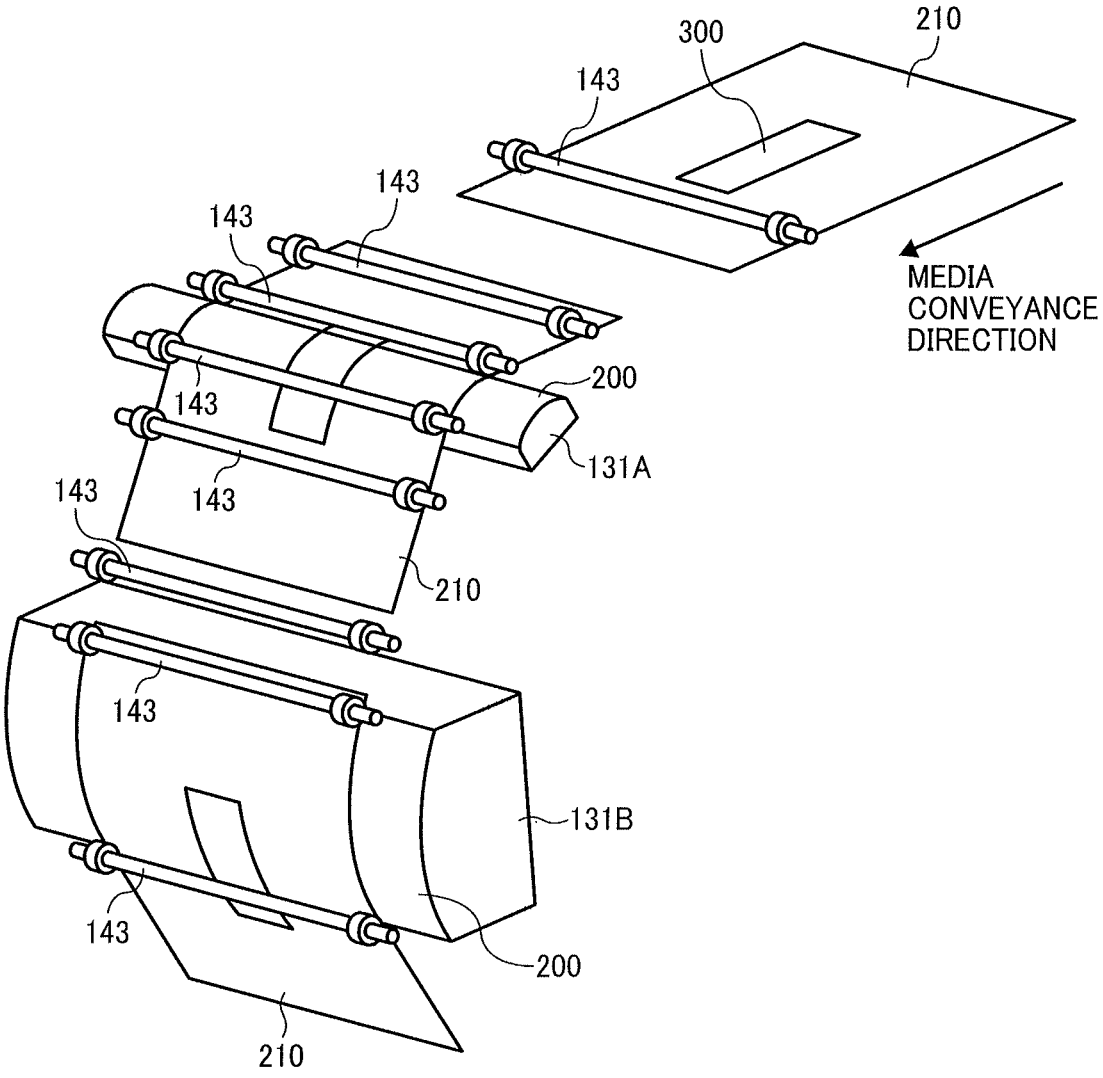
FIG. 19 is an explanatory partial view of the drying device illustrating a principal part thereof according to a twelfth embodiment of the present invention.

Next, a twelfth embodiment according to the present invention will be described with reference to FIG. 19. FIG. 19 is an explanatory partial view illustrating a principal part of the drying device according to the twelfth embodiment of the present invention.

In the present embodiment, the curved surface heaters 131A, 131B, instead of the heat roller, are disposed as contact members serving as media heating members from upstream along the media conveyance direction. The curvature of the contact surface of the curved surface heater 131B disposed downstream is smaller than that of the upstream curved surface heater 131A.

In the present embodiment, because a cut sheet is used as a medium 210, a plurality of feed rollers 143 are disposed at an entrance side and an exit side of the curved surface heaters 131A, 131B.

With this configuration, the medium 210 on which a liquid is adhered and an image 300 is formed contacts a contact surface 200 of the curved surface heater 131A, and the cockling is corrected after the shape of the contact surface of the curved surface heater 131A, and is heated and dried by the close contact with a rear surface of the medium 210.

In this state, because the liquid on the medium 210 is dried to a certain degree, the cockling recovered after passing through the curved surface heater 131A is reduced.

Thereafter, the medium 210 contacts a contact surface of the curved surface heater 131B, having a relatively large curvature, and the cockling is corrected after the shape of the contact surface of the curved surface heater 131B, and is heated and dried by the close contact with a rear surface of the medium 210. In this case, because the curvature of the curved surface heater 131B is smaller than that of the curved surface heater 131A, the contact time period with the medium 210 is longer, thereby accelerating heat transfer and drying. In this step, because the liquid of the medium 210 is further dried, the cockling recovered after passing through the curved surface heater 131B becomes smaller than in the previous step (after passing through the curved surface heater 131A).

Thus, by providing a plurality of contact members with a curvature sequentially reducing toward downstream in the media conveyance direction, cockling is reliably reduced and drying is performed effectively.

It is preferred that the contact surface of each of the curved surface heaters 131A, 131B be formed of part of the circumference having a radius R that equals 125 mm or less when using a medium with a basis weight of 100 gsm or more, and a radius R=75 mm or less when using a medium with a basis weight of less than 100 gsm.

However, the radius R does not need to be constant, and the maximum curvature may only correspond to R=125 mm or the radius R=75 mm or less. The radius R=50 mm or less is more preferable from the view of cockling correction.

When the medium is cockled, if the medium is separated from the contact surface or heating surface of the contact member more than 0.1 mm, the heat transfer efficiency drastically decreases. When the basis weight is equal to 100 gsm or more, if the R=125 mm or 100 mm, the medium 210 closely contacts the contact surface. When the basis weight is less than 100 gsm, the medium 210 closely contacts the contact surface when the R=75 mm or 50 mm.

For example, relative to the coated paper having a basis weight of 90 gsm, when the curvature is R50, the distance between the coated paper and the heating surface becomes 0.02 mm or less.

Figure 20:
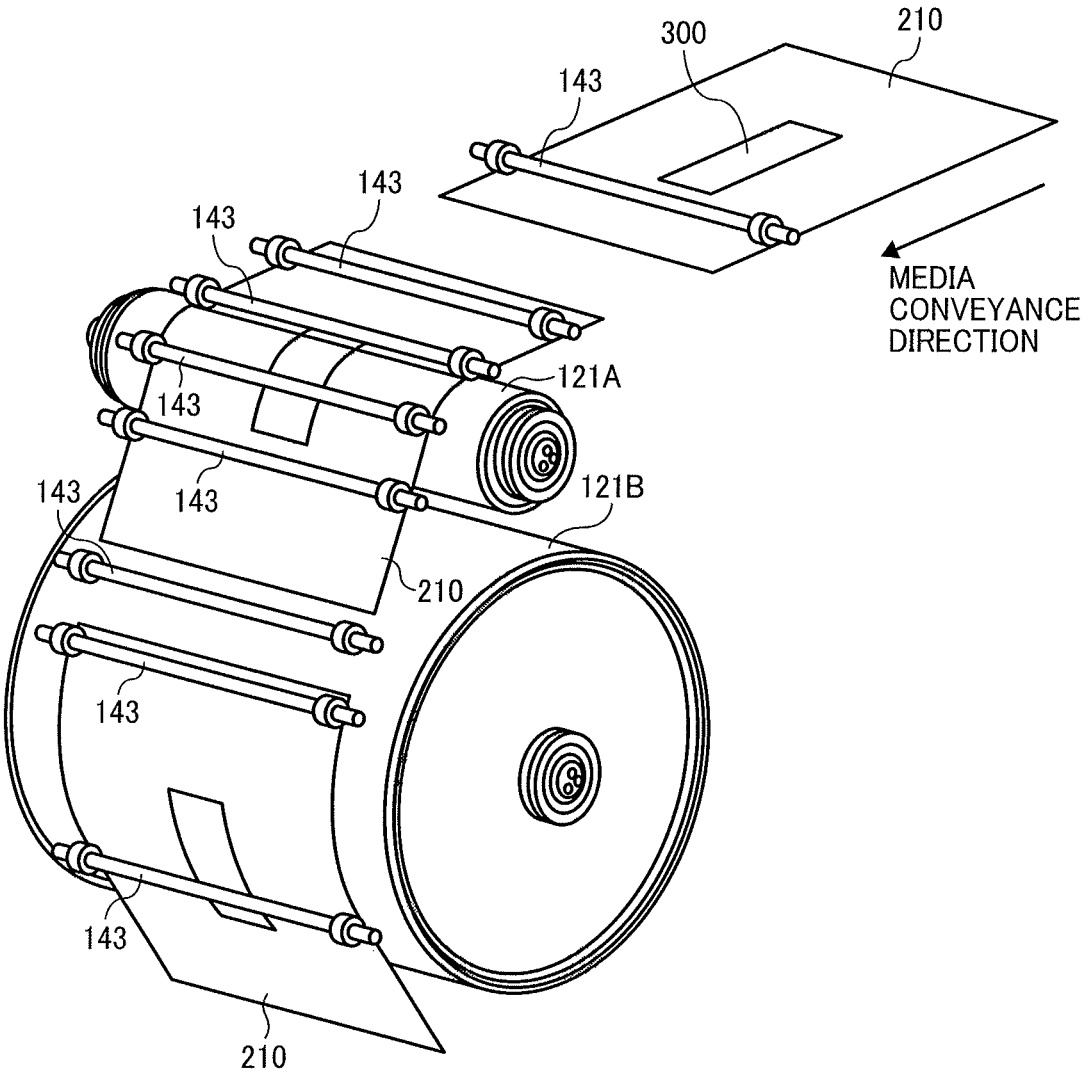
FIG. 20 is an explanatory view of the drying device illustrating a principal part thereof according to a thirteenth embodiment of the present invention.

Next, a thirteenth embodiment according to the present invention will be described with reference to FIG. 20. FIG. 20 is an explanatory view of the drying device 104 illustrating a principal part according to the thirteenth embodiment of the present invention.

In the present embodiment, heat rollers 121A, 121B are disposed in this order each as a contact member to construct a media heating member from upstream along the media conveyance direction. The curvature of the contact surface of the heat roller 121B disposed downstream is smaller than that of the upstream heat roller 121A.

In the present embodiment, because a cut sheet is used as a medium 210, a plurality of feed rollers 143 are disposed at an entrance side and an exit side of the curved surface heaters 131A and 131B.

With this configuration, the medium 210 contacts a circumferential surface of the heat roller 121A with a relatively greater curvature, the cockling thereof is corrected after the circumferential shape of the heat roller 121A, and the medium 210, a rear side of which the heat roller 121A closely contacts, is heated and dried.

In this step, because the liquid on the medium 210 is dried to a certain degree, the cockling recovered after passing through the heat roller 121A becomes smaller than in an earlier time.

Thereafter, the medium 210 contacts a circumferential surface of the heat roller 121B with a relatively small curvature, the cockling thereof is corrected after the circumferential shape of the heat roller 121B, and the medium 210, a rear side of which the heat roller 121B closely contacts, is heated and dried. In this case, because the curvature of the heat roller 121B is smaller than that of the heat roller 121A, the contact time period with the medium 210 is longer, thereby accelerating heat transfer and drying. In this step, because the liquid of the medium 210 is further dried, the cockling recovered after passing through the heat roller 121B becomes smaller than in the previous step (after passing through the heat roller 121A).

Thus, by providing a plurality of contact members with a curvature sequentially reducing toward downstream in the media conveyance direction, cockling is reliably reduced and drying is performed effectively.

It is preferred that the diameter ϕ of the heat rollers 121A, 121B equal 250 mm or less when using a medium with a basis weight of 100 gsm or more, and the diameter ϕ thereof equal 150 or less when using a medium with a basis weight of less than 100 gsm. The radius R=50 mm or less is more preferable from the view of cockling correction. In addition, as to the curvature, it is preferable that the diameter ϕ is equal to 100 mm or less from the point of cockling correction. When the roller width is 589 mm, the diameter ϕ is preferably 30 mm or more from the point of strength.

Figure 21:
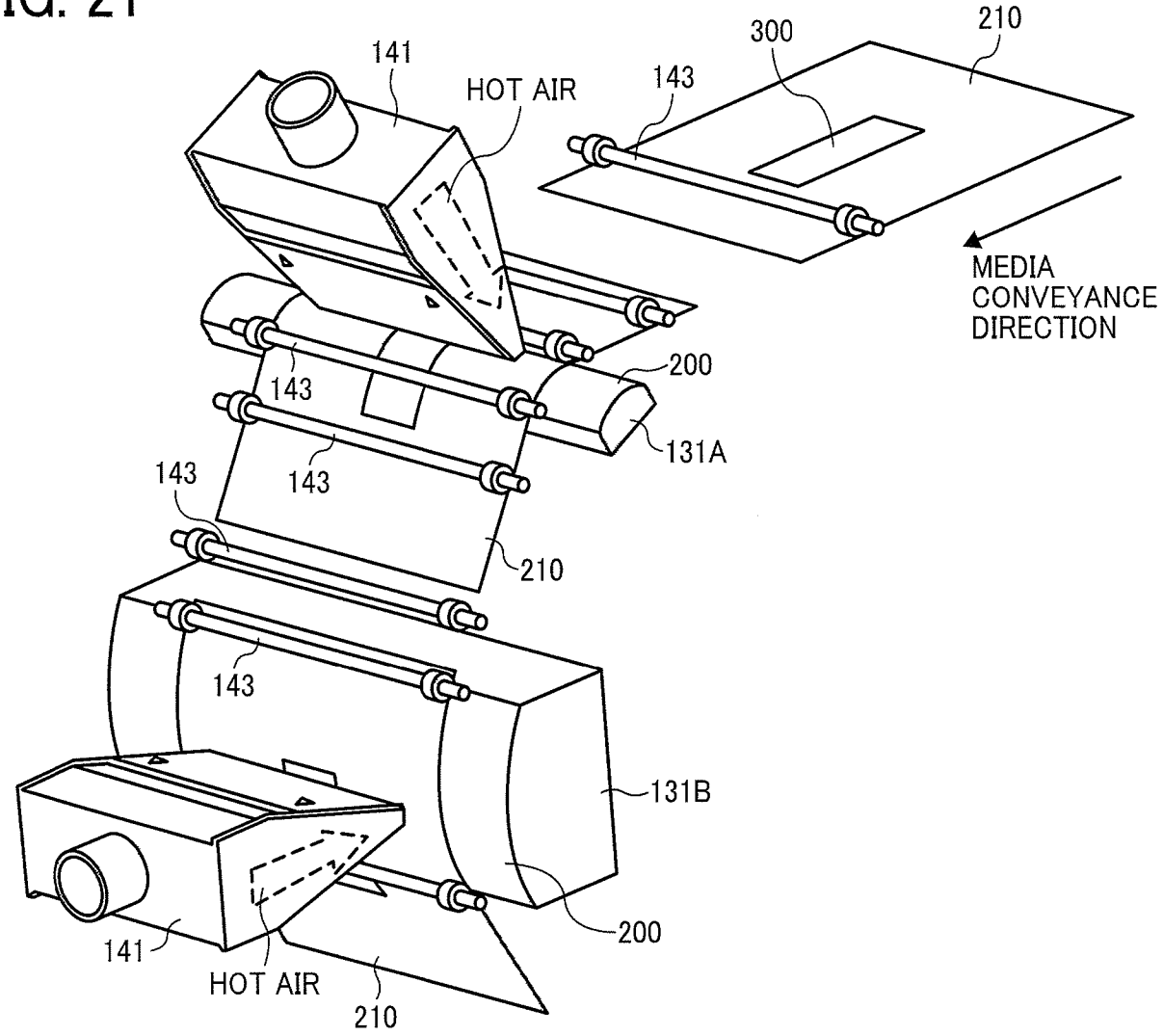
FIG. 21 is an explanatory view of the drying device illustrating a principal part thereof according to a fourteenth embodiment of the present invention.

Next, a fourteenth embodiment according to the present invention will be described with reference to FIG. 21. FIG. 21 is an explanatory view of the drying device 104 illustrating a principal part thereof according to the fourteenth embodiment of the present invention.

In the present embodiment, a plurality of hot air blowers 141 is disposed to blow the hot air to an area of the medium 210 heated by the contact surface of each of the curved surface heaters 131A, 131B.

With such a configuration, the medium 210 is heated by the curved surface heaters 131A, 131B and heated by the hot air blown from the hot air blower 141. At the same time, the temperature boundary layer that evaporated liquid solvent forms on a surface of the medium 210 thins out and heat transfer is accelerated.

With this structure, the medium 210 can be dried more effectively.

It is preferred that the hot air blown from the hot air blower 141 blow at a relative speed of 20 m/s or more relative to the medium 210 on the surface of the medium 210. At the same time, the temperature boundary layer that evaporated liquid solvent forms on a surface of the medium 210 can be removed securely and the heat transfer is accelerated.

Figure 22:
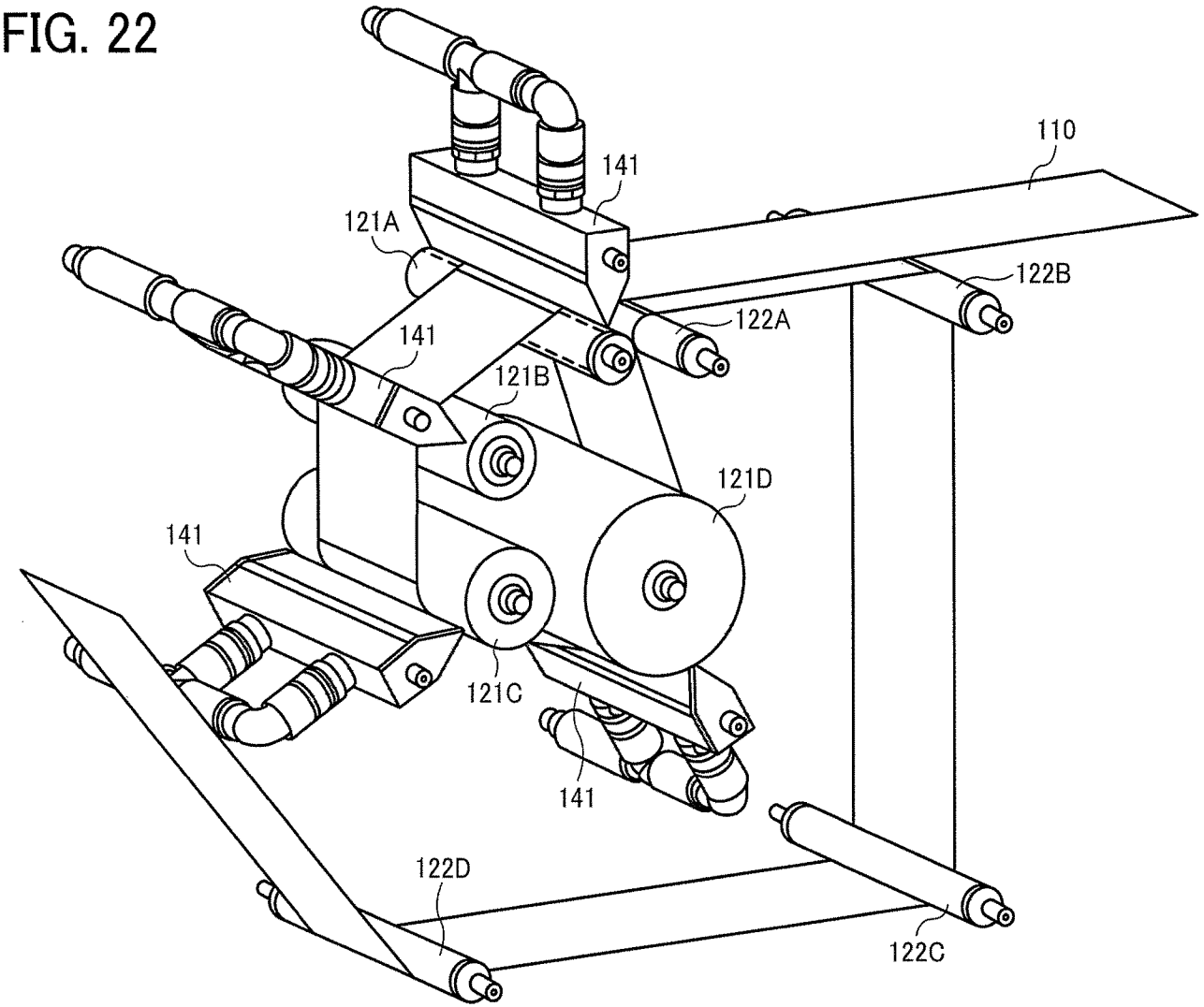
FIG. 22 is an explanatory view of the drying device 104 illustrating a principal part thereof according to a fifteenth embodiment of the present invention.

Next, a fifteenth embodiment according to the present invention will be described with reference to FIG. 22. FIG. 22 is an explanatory view of the drying device 104 illustrating a principal part thereof according to the fifteenth embodiment of the present invention.

In the present embodiment, a plurality of hot air blowers 141 is disposed to blow the hot air to an area of the medium 110 heated by the contact surface (or the circumferential surface) of each of the heat rollers 121A to 121D.

With such a configuration, the medium 110 is heated by the heat rollers 121A to 121D and by the air blown from the hot air blower 141. At the same time, the temperature boundary layer that evaporated liquid solvent forms on a surface of the medium 110 thins out and heat transfer is accelerated.

With this structure, the medium 110 can be dried more effectively.

It is preferred that the hot air blown from the hot air blower 141 blow at a relative speed of 20 m/s or more relative to the medium 210 on the surface of the medium 110. With this structure, the temperature boundary layer that evaporated liquid solvent forms at a surface of the medium 110 can be removed securely and the heat transfer is accelerated.

Figure 23:
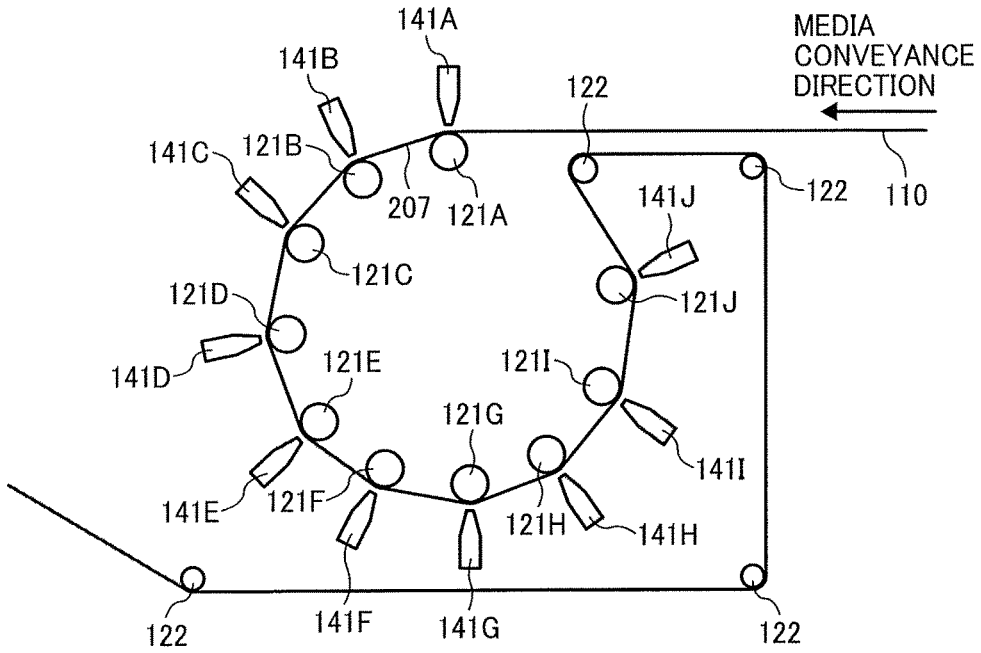
FIG. 23 is a perspective view of the heating member illustrating a sixteenth embodiment of the present invention.

Next, a sixteenth embodiment according to the present invention will be described with reference to FIG. 23. FIG. 23 is a perspective view of the heating member illustrating the sixteenth embodiment of the present invention.

In the present embodiment, a plurality of heat rollers 121A to 121J and a plurality of hot air blowers 141 to 141J are disposed along the media conveyance direction. These plural heat rollers and hot air blowers are circularly arranged.

Herein, a total ten heating members and a toner ten hot air blowers are provided; however, the number is not limited to ten and can be more than 10, and numbers from three to nine are selected appropriately. As described above, the contact area of one heat roller ranges 90 degrees or less in the media conveyance direction, to thereby achieve a reliable heating and direction change while saving a space.

With such a structure, a plurality of heat rollers and hot air blowers can be disposed in a reduced space and drying effect can be improved.

In addition, as described above, an entire width of the rear surface of the medium 110 closely contacts the heat rollers 121, thereby suppressing extension and contraction in the media width direction due to heat. Accordingly, a difference in the extension and contraction between an image forming area and a non-printing area serves as an internal stress. However, because restriction in the media width direction is once released at a position 207 between the heat roller 121 and the next heat roller 121, the internal stress due to difference in the extension and contraction is moderated. As a result, when the medium 110 contacts the next heat roller 121, the difference in the extension and contraction is further uniformed. Thereby, correction effect of the cockling is accelerated.

Figure 24:
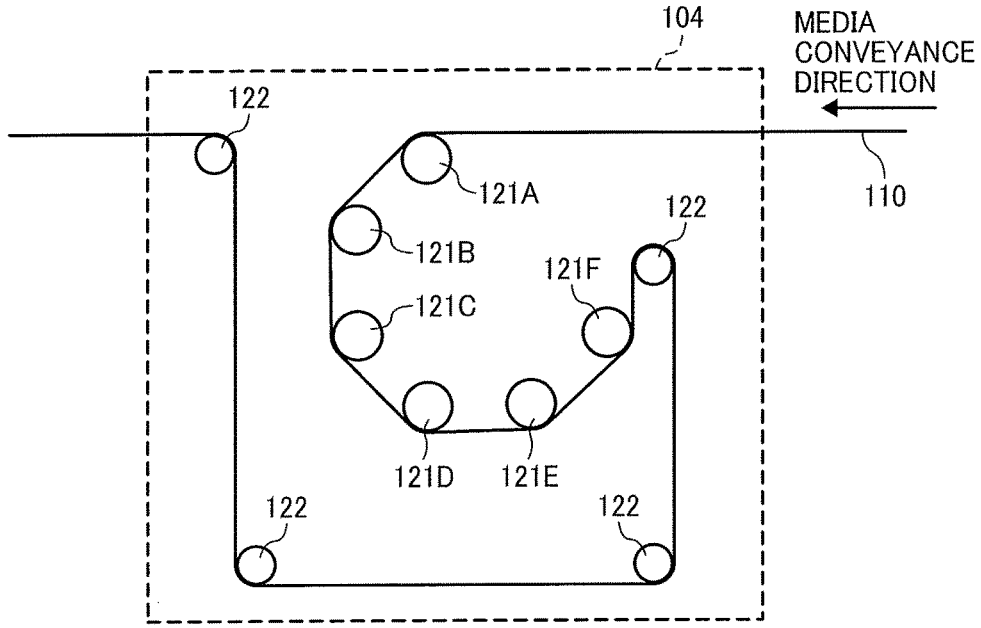
FIG. 24 illustrates a drying device according to a seventeenth embodiment.

Next, a seventeenth embodiment according to the present invention will be described with reference to FIG. 24. FIG. 24 illustrates a drying device 104 according to the seventeenth embodiment.

In the present embodiment, six heat rollers 121A to 121F are disposed in a circle along the media conveyance direction. The number of heaters is not limited to six and can be two to five or more than seven.

Figure 25:
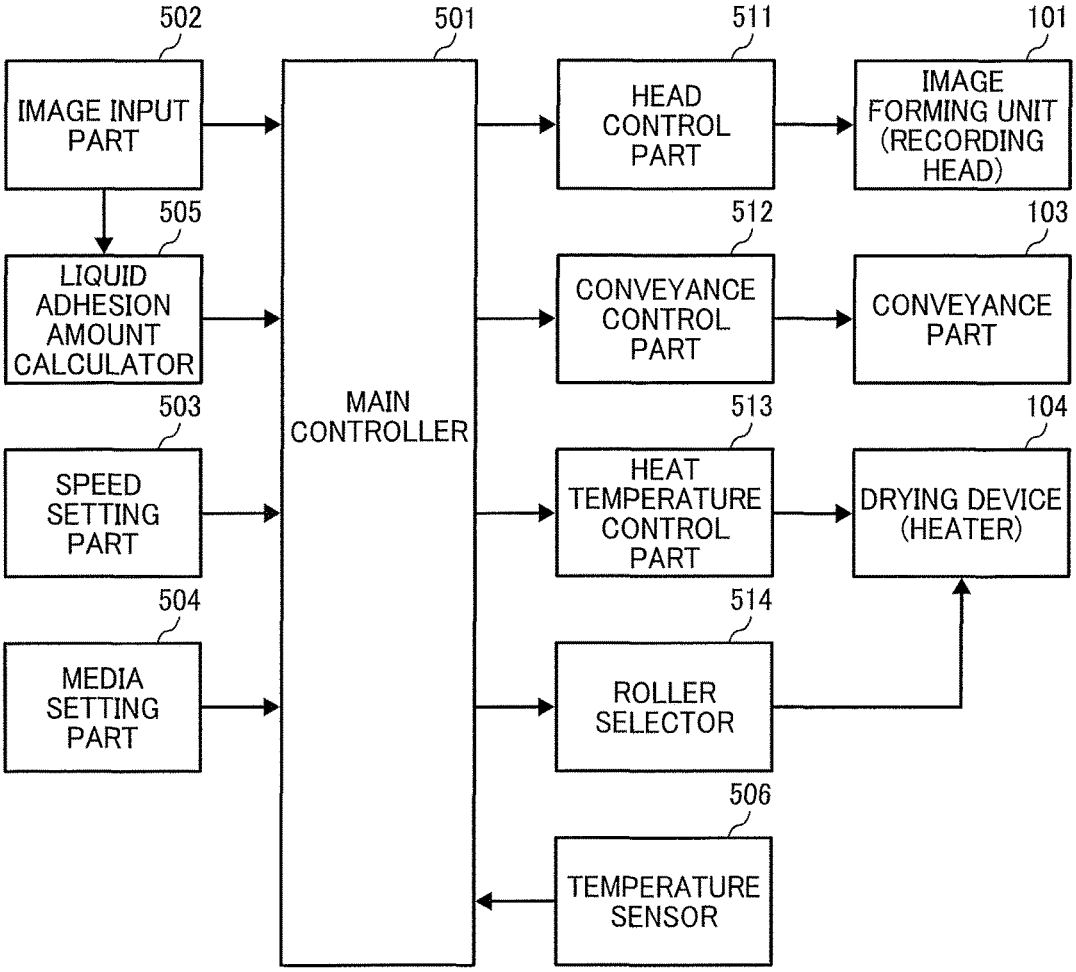
FIG. 25 is a block diagram of an exemplary controller section.

Referring to FIG. 25, a controlling section of the preferred embodiments of the present invention will be described. FIG. 25 is a block diagram of an exemplary controller section.

The controller section according to the present embodiment includes a roller selector 514 serving as a selector to select a heat roller to be used for heating the medium among the plurality of heat rollers of the drying device 104.

Herein, the roller selector 514 selects a heat roller for use in accordance with a media conveyance speed as a printing condition. To be more specific, the roller selector 514 determines a number of use heat rollers (or a number of contact members) and a position thereof according to preset printing conditions, and selects heat rollers matching with the printing conditions.

Other parts and components are the same as the controlling section illustrated with reference to FIG. 7, and therefore, a further explanation will be omitted.

Figure 26:
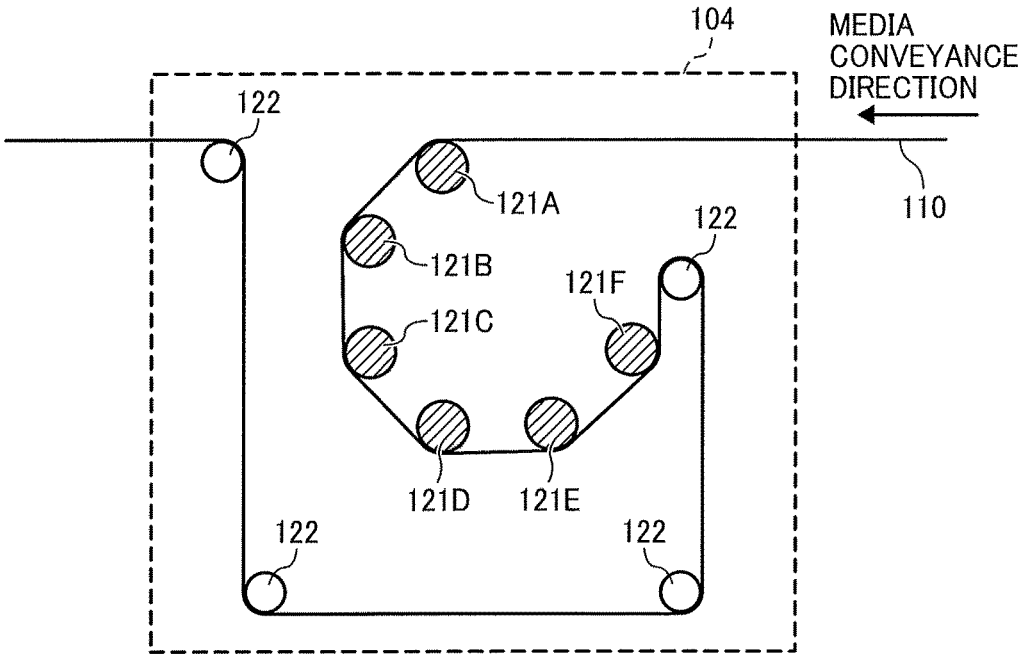
FIG. 26 illustrates one example of heat rollers used in heating concerning a number and positions thereof.
Figure 27:
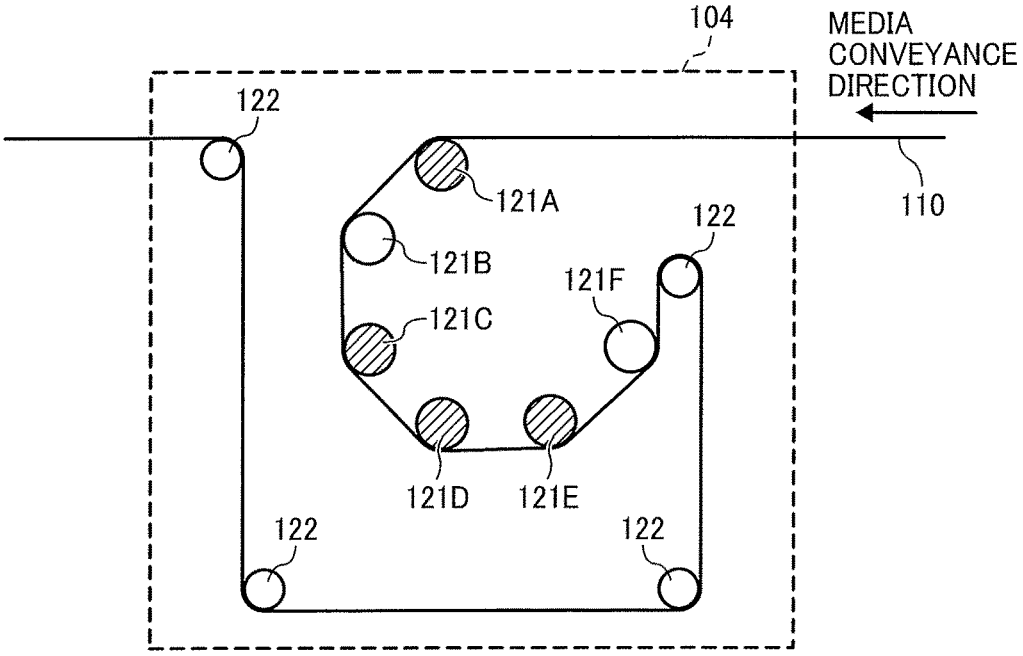
FIG. 27 illustrates one example of the number and positions of the heat rollers used in heating.
Figure 28:
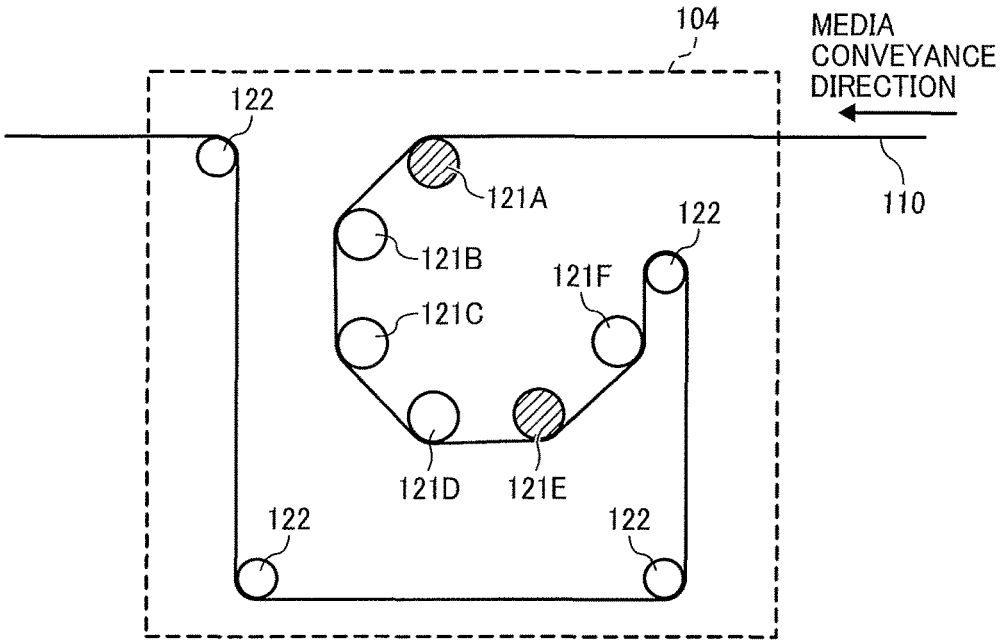
FIG. 28 illustrates one example of the number and positions of the heat rollers used in heating.

Next, referring to FIGS. 26 to 28, one example of the number of the heat rollers used in heating and disposed positions thereof will be described. FIGS. 26 to 28 illustrate examples of drying devices 104.

Heat-generating heat rollers in operation in FIGS. 26 to 28 are indicated by hatching.

FIG. 26 shows that all heat rollers 121A to 121F are used for heat generation.

FIG. 27 shows that among six heat rollers 121A to 121F, four heat rollers 121A, and 121C to 121E are caused to generate heat.

FIG. 28 shows that, of six heat rollers 121A to 121F, two heat rollers 121A, and 121E are caused to generate heat.

The numbers and positions of the heat rollers used for heating are not limited to the above examples.

Figure 29:
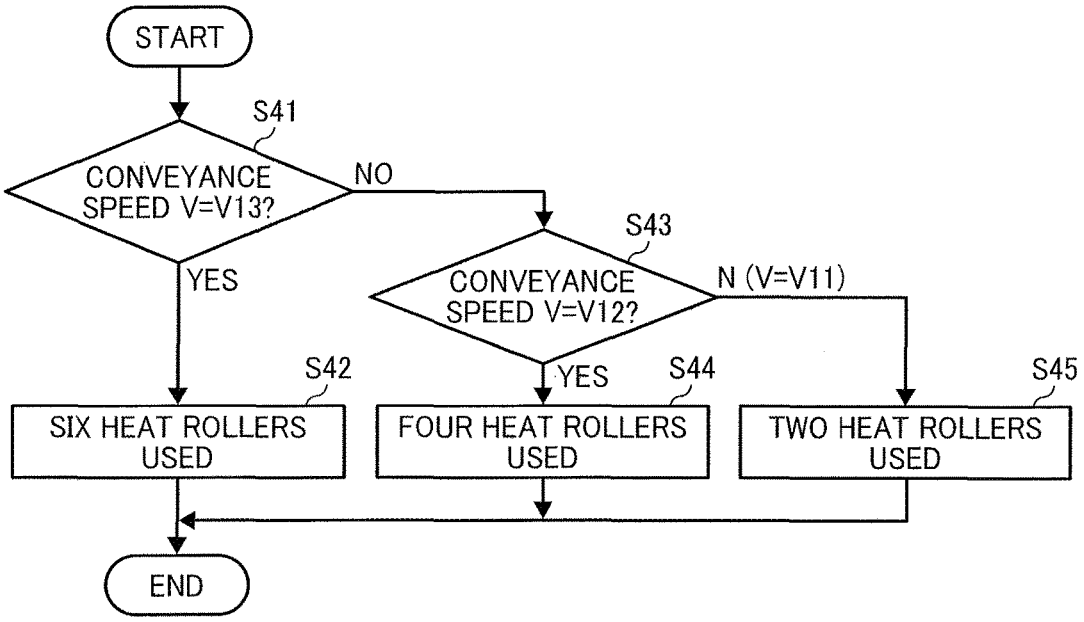
FIG. 29 is a flowchart to control a number of media heating members for use in the seventeenth embodiment.

Next, a heating control of the controlling section according to the present embodiment will be described with reference to a flowchart of FIG. 29.

The main controller 501 determines whether or not a media conveyance speed V set by the speed setting part 503 is a predetermined speed V13 (in step S41).

When the media conveyance speed V equals the predetermined speed V13, the number of heat rollers 121 is set to six, and causes the heat rollers 121A to 121F to generate heat as illustrated in FIG. 26 (S42).

By contrast, when the media conveyance speed V is not equal to the predetermined speed V13, the main controller 501 determines whether or not the media conveyance speed V is a predetermined speed V12 ($V12<V<V13$) (S43).

When the media conveyance speed V equals the predetermined speed V12, the number of heat rollers 121 is set to four, and causes the heat rollers 121A, and 121C to 121E to generate heat as illustrated in FIG. 27 (S44).

By contrast, when the media conveyance speed V is not equal to the predetermined speed V12 and is equal to a predetermined speed V11 ($V11<V<V12$), the number of heat rollers 121 is set to two, and causes the heat rollers 121A, and 121E to generate heat as illustrated in FIG. 28 (S45).

Figures 30, 31, 32:
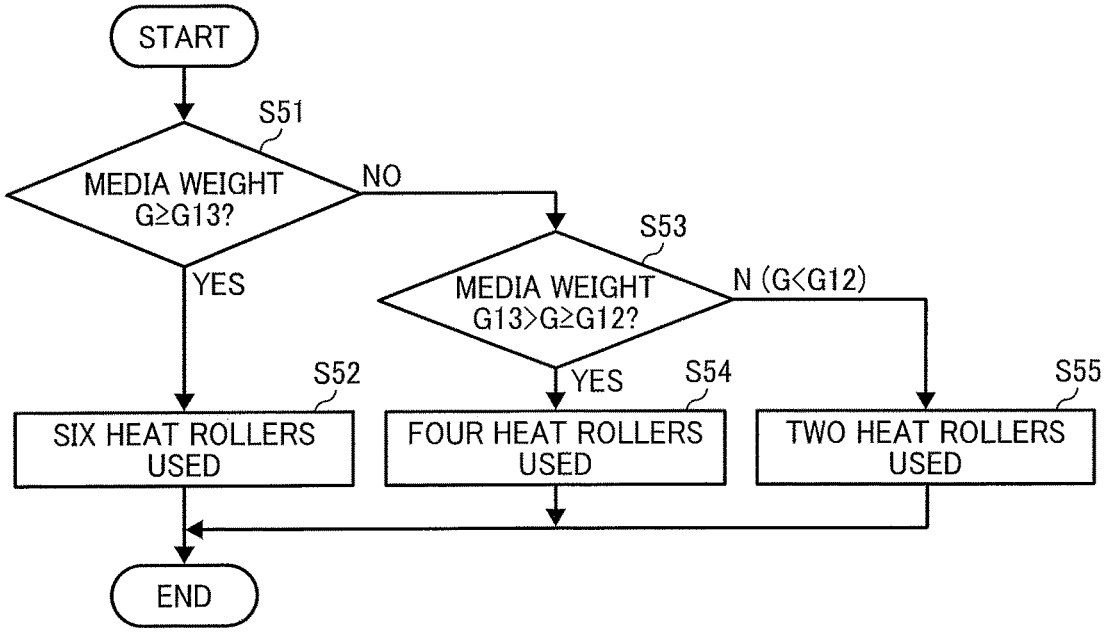
FIG. 30 is a table showing an actual exemplary media conveyance speed by the number of use heaters.
FIG. 31 is a flowchart of steps in a process to control a number of media heating members for use in an eighteenth embodiment of the present invention.
FIG. 32 is a table showing an actual exemplary basis weight of the medium by the number of use heaters.

As illustrated in FIG. 30, when the media conveyance speed (printing speed) V is equal to 30 m/min, the number of heat rollers to be used (that is, "number of heaters used" in FIG. 30) is set to six. Similarly, when the media conveyance speed V is equal to 20 m/min, the number of heat rollers is set to four. Further similarly, when the media conveyance speed V is equal to 10 m/min, the number of heat rollers is set to two.

Specifically, as the conveyance speed of the medium 110 increases, the time to contact the heat roller 121 shortens, and the time to dry the medium 110 also shortens. Thus, to reliably dry the liquid, the number of heat rollers to be used for heating is increased.

On the other hand, as the conveyance speed of the medium 110 decreases, the time to contact the heat roller 121 lengthens, so that the medium 110 is dried excessively. To prevent an excessive drying, the number of heat rollers to be used is reduced.

Thus, by changing the number of media heating members according to the media conveyance speed, the excessive drying is prevented and the drying is reliably performed.

Next, referring to a flowchart of FIG. 31, an eighteenth embodiment of the present invention will be described.

The main controller 501 determines whether or not a basis weight G of the medium set by the media setting part 504 is equal to or greater than a predetermined amount G13 ($G13 \leq G$) (in step S51).

When the basis weight G of the medium is equal to or greater than a predetermined amount G13, the number of heat rollers 121 is set to six, and the main controller 501 causes the heat rollers 121A to 121F to generate heat as illustrated in FIG. 26 (S52).

By contrast, when the basis weight G of the medium is not equal to or greater than the predetermined amount G13, the main controller 501 determines whether or not the basis weight G of the medium is equal to the predetermined amount G12 or greater and less than the predetermined amount G13 (G12≤G<G13) (S53).

When the basis weight G of the medium is equal to the predetermined amount G12 or greater and less than the predetermined amount G13 (G12≤G<G13), the number of heat rollers 121 is set to four, and the main controller 501 causes the heat rollers 121A, and 121C to 121E to generate heat as illustrated in FIG. 27 (S54).

When the basis weight G of the medium is not equal to the predetermined amount G12 or greater and less than the predetermined amount G13 (G12≤G<G13), specifically, when the basis weight G of the medium is less than the predetermined amount G12, the number of heat rollers 121 is set to two, and the main controller 501 causes the heat rollers 121A, and 121E to generate heat as illustrated in FIG. 28 (S55).

For example, as illustrated in FIG. 32, when the basis weight G of the medium is equal to and greater than 100 gsm, the number of heat rollers is set to six. Similarly, when 60 gsm≤G<100 gsm, the number of heat rollers for use is set to four. Further similarly, when G<100 gsm, the number of heat rollers is set to two.

In short, when the basis weight of the medium 110, or the thickness thereof, increases, more energy is required for heating by the heat roller 121. Thus, to reliably dry the liquid impacted on the medium, the number of heat rollers 121 to be used for heating is increased.

On the other hand, when the basis weight of the medium 110, or the thickness thereof, decreases, necessary calories also lessen, so that it is needed to prevent an excessive drying. To prevent an excessive drying, the number of heat rollers to be used is reduced.

Thus, by changing the number of media heating members according to the basis weight of the medium, the excessive drying is prevented and the drying is reliably performed.

Next, referring to a flowchart of FIG. 33, a nineteenth embodiment of the present invention will be described.

The main controller 501 determines whether or not a liquid adhesion amount D calculated by the liquid adhesion amount calculator 505 is equal to or greater than a predetermined amount D13 (D13≤D) (in step S61).

When the liquid adhesion amount D is equal to or greater than the set predetermined amount D13, the number of heat rollers to be used for heating is set to six, and the main controller 501 causes the heat rollers 121A to 121F to generate heat as illustrated in FIG. 26 (S62).

By contrast, when the liquid adhesion amount D is not equal to or greater than the set predetermined amount D13, the main controller 501 determines whether or not the liquid adhesion amount D is equal to or greater than the predetermined amount D12 and less than the predetermined amount D13 (D12≤D<D13) (S63).

When the liquid adhesion amount D is equal to or greater than the set predetermined amount D12 and less than the predetermined amount D13 (D12≤D<D13), the number of heat rollers 121 to be used for heating is set to four, and the main controller 501 causes the heat rollers 121A, and 121C to 121E to generate heat as illustrated in FIG. 27 (S64).

By contrast, when the liquid adhesion amount D is not equal to or greater than the set predetermined amount D12 and less than the predetermined amount D13, that is, the liquid adhesion amount D is less than the predetermined amount D12, the main controller 501 sets the number of heat rollers 121 to be used for heating to four, and causes the heat rollers 121A, and 121E to generate heat as illustrated in FIG. 28 (S65).

Figures 33, 34:
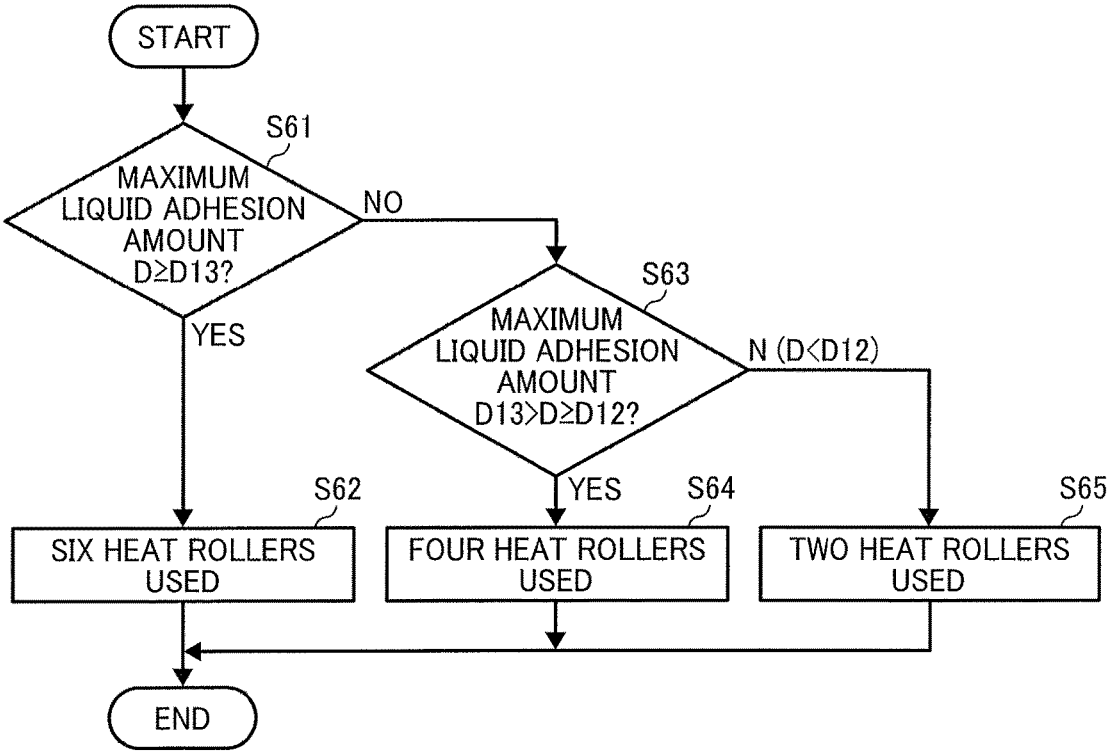
FIG. 33 is a flowchart of steps in a process to control a number of media heating members for use in a nineteenth embodiment of the present invention.
FIG. 34 is a table showing an actual exemplary maximum ink adhesion amount by the number of use heaters.

For example, as illustrated in FIG. 34, when the liquid adhesion amount (or the maximum adhesion amount) D [μl/inch$^2$] relative to the medium is equal to or greater than 3.0, the number of heat rollers to be used for heating is set to six. Similarly, when 2.0<D≤3.0, the number of heat rollers for use is set to four. Further similarly, when D<2.0, the number of heat rollers is set to two.

In short, when the liquid adhesion amount relative to the medium 110 increases, drying the medium 110 by the heat roller 121 requires more energy. Thus, to reliably dry the liquid impacted on the medium, the number of heat rollers 121 to be used for heating is increased.

On the other hand, when the liquid adhesion amount relative to the medium 110 decreases, necessary calories for heating reduce, so that the excessive drying needs to be prevented. To prevent the excessive drying, the number of heat rollers 121 to be used for heating is reduced.

Thus, by changing the number of media heating members according to the liquid adhesion amount relative to the medium, the excessive drying is prevented and the drying is reliably performed.

Printing conditions are divided into three steps in the above embodiments; however, the number of heat rollers can be controlled by dividing the printing condition into two steps or more than four steps.

Figure 35:
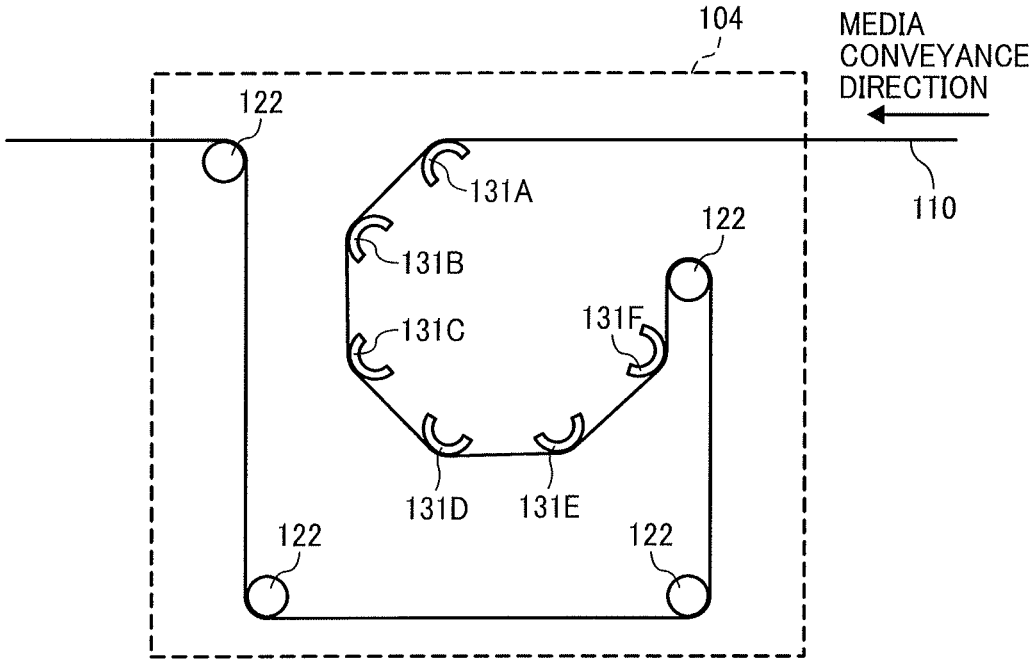
FIG. 35 illustrates a drying device according to a twentieth embodiment.

Next, a twentieth embodiment according to the present invention will be described with reference to FIG. 35. FIG. 35 illustrates a drying device according to the twentieth embodiment.

In the present embodiment, instead of the heat rollers 121A to 121F according to the ninth embodiment, curved surface heaters 131A to 131F are disposed in a circle.

Even though such media heating members are used, the heating and drying control as described in the ninth to eleventh embodiments can be performed.

Each of the above embodiments may be combined each other on a consistent basis.

The term "sheet" means a substantially same matter as meant by recorded medium, recording medium, recording sheet, and the like, and the term "image formation" means a substantially same matter as meant by recording, printing, image printing, and the like.

The term "image forming apparatus" means an apparatus to perform image formation by jetting liquid droplets to various media. The term "image formation" means not only forming images with letters or figures having meaning to the medium, but also forming images without meaning such as patterns to the medium (and simply jetting the droplets to the medium).

The term "image" is not limited to a plane two-dimensional one, but also includes a three-dimensional one, and the image formed by three-dimensionally from the 3D figure itself.

Further, the image forming apparatus includes, otherwise limited in particular, any of a serial-type image forming apparatus and a line-type image forming apparatus.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image forming unit to form an image on a medium by discharging liquid droplets onto the medium; and a media heater to heat the medium, wherein the media heater includes a plurality of contact heat members that heat the medium by contacting the medium with a contact surface having a predetermined curvature that the medium contacts, wherein the contact heat members include:

a first contact heat member having the smallest curvature among all of the contact heat members; and a second contact heat member disposed upstream from the first contact heat member and downstream from the image forming unit in the media conveyance direction, wherein each of the first contact heat member and the second contact heat member contacts an opposite surface, opposite to a surface of the medium on which the image has been formed.

2. The image forming apparatus as claimed in claim 1, wherein the second contact heat member includes at least three second contact heat members disposed in an arc.

3. The image forming apparatus as claimed in claim 1, wherein the second contact heat member includes a contact surface with a radius R that is equal to or less than 125 mm.

4. The image forming apparatus as claimed in claim 1, wherein the second contact heat member includes a contact surface with a radius R that is equal to or less than 75 mm.

5. An image forming apparatus comprising:

an image forming unit to form an image on a medium by discharging liquid droplets onto the medium; and a media heater to heat the medium, wherein the media heater includes a plurality of heat rollers with a contact surface having a predetermined curvature that the medium contacts, wherein the heat rollers include:

a first heat roller having the largest radius among all of the heat rollers; and a second heat roller disposed upstream from the first heat roller and downstream from the image forming unit in the media conveyance direction, wherein each of the first heat roller and the second heat roller contacts an opposite surface, opposite to a surface of the medium on which the image has been formed.

6. The image forming apparatus as claimed in claim 5, wherein the second heat roller includes at least three second heat rollers disposed in an arc.

7. The image forming apparatus as claimed in claim 5, wherein the second heat roller includes a contact surface with a radius R that is equal to or less than 125 mm.

8. The image forming apparatus as claimed in claim 5, wherein the second heat roller includes a contact surface with a radius R that is equal to or less than 75 mm.

9. A drying device comprising:

a media heater to heat a medium, wherein the media heater includes a plurality of contact heat members that heat the medium by contacting the medium, each having a contact surface of a corresponding predetermined curvature that the medium contacts, wherein the contact heat members include:

a first contact heat member having the smallest curvature among all of the contact heat members; and a second contact heat member disposed upstream from the first contact heat member.

10. The drying device as claimed in claim 9, wherein the second contact heat member includes at least three second contact heat members disposed in an arc.

11. The drying device as claimed in claim 9, wherein the second contact heat member includes a contact surface with a radius R that is equal to or less than 125 mm.

12. The drying device as claimed in claim 9, wherein the second contact heat member includes a contact surface with a radius R that is equal to or less than 75 mm.

* * * * *